US006445274B1

(12) United States Patent
Malingowski et al.

(10) Patent No.: US 6,445,274 B1
(45) Date of Patent: Sep. 3, 2002

(54) CIRCUIT INTERRUPTER WITH THERMAL TRIP ADJUSTABILITY

(75) Inventors: Richard Paul Malingowski, Finleyville; Craig Allen Rodgers, Butler; Lance Gula, Clinton; Teresa Inez Hood, Pittsburgh; Raymond Peter Gundy, Indiana; Jonathan Moore Peifer, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 53 days.

(21) Appl. No.: 09/710,244

(22) Filed: Nov. 10, 2000

(51) Int. Cl.[7] ..... H01H 37/52; H01H 37/12; H01H 61/00

(52) U.S. Cl. ..... 337/49; 337/36; 337/42; 337/333; 335/23; 335/202

(58) Field of Search ..... 337/36–50, 3, 337/35, 13, 333, 334; 335/202, 23

(56) References Cited

U.S. PATENT DOCUMENTS 4,503,408 A * 3/1985 Mrenna et al. ..... 335/23
4,698,606 A 10/1987 Mrenna et al. ..... 335/45
4,704,593 A 11/1987 Leone et al. ..... 337/82
4,922,220 A 5/1990 Livesey et al. ..... 337/82
5,831,509 A * 11/1998 Elms et al. ..... 335/35
5,844,466 A * 12/1998 Fraisse ..... 337/16
5,894,259 A * 4/1999 Kolberg et al. ..... 335/10
5,910,760 A * 6/1999 Malingowski et al. ..... 335/167
6,160,470 A * 12/2000 O'Carrol et al. ..... 200/286
6,208,228 B1 * 3/2001 Gula et al. ..... 335/132
6,356,175 B1 * 3/2002 DeGrazia et al. ..... 335/132

* cited by examiner

*Primary Examiner*—Jayprakash N. Gandhi
(74) *Attorney, Agent, or Firm*—Charles E. Kosinski

(57) ABSTRACT

A circuit interrupter including a housing, separable main contacts within the housing, and an operating mechanism within the housing and interconnected with the separable main contacts. A trip mechanism is disposed within the housing that includes a trip bar assembly rotatable about an axis and that, when rotated, generates a tripping operation causing the operating mechanism to open the contacts. The trip bar assembly includes a trip member translatable along the axis. The trip mechanism includes a tripping actuator movable along a predetermined path of travel as a function of electrical current. The tripping actuator contacts a contact area of the trip member at a predetermined location along the predetermined path of travel of the tripping actuator and causes the trip bar assembly to rotate and generate the tripping operation upon a predetermined current threshold. When the trip member is translated along the axis, the contact area is contacted by the tripping actuator at a different location along the predetermined path of travel of the tripping actuator whereby the predetermined current threshold is changed.

20 Claims, 21 Drawing Sheets

CIRCUIT INTERRUPTER WITH THERMAL TRIP ADJUSTABILITY

BACKGROUND OF THE INVENTION

1. Field of the Invention

The present invention relates to circuit interrupters generally and, more specifically, to those kinds of circuit interrupters having a thermal tripping operation.

2. Description of the Prior Art

Molded case circuit breakers and interrupters are well known in the art as exemplified by U.S. Pat. No. 4,503,408 issued Mar. 5, 1985, to Mrenna et al., and U.S. Pat. No. 5,910,760 issued Jun. 8, 1999 to Malingowski, et al, each of which is assigned to the assignee of the present application and incorporated herein by reference.

A continuing industry objective with respect to many types of circuit interrupters is to be able to reduce the size and/or footprint of the interrupter housing while at the same time providing the same or improved performance capabilities. A major advantage of creating such a "smaller package" is that it provides increased flexibility in installation. However, a consequence of this objective is that the internal space constraints of such interrupters have become much more limiting, posing certain design obstacles that need to be overcome.

Circuit interrupters advantageously provide for automatic circuit interruption (opening of the contacts) when an overcurrent condition is determined to exist. One way of determining whether or not an overcurrent condition exists is to provide a trip mechanism with a rotatable trip bar assembly and a bimetal through which current flows. The bimetal reacts to overcurrent conditions by heating up and bending towards the trip bar assembly. Above a predetermined current level (overcurrent conditions), the bimetal bends far enough so as to cause a rotation of the trip bar assembly which sets in motion a tripping operation.

It is desirable to be able to adjust the predetermined current level that causes the above-described thermal tripping operation. In the prior art, such adjustment could be made by changing the size and/or shape of the bimetal. In addition, adjustment could be made by selectively screwing a screw through an opening in a bottom portion of the bimetal such that it protrudes to a certain extent towards the trip bar assembly. The screw is positioned to contact the trip bar assembly (and cause rotation thereof) when the bimetal bends, and the variability of the extent of its protrusion towards the trip bar assembly selectively increases or reduces the amount of deflection that is necessary to cause a thermal tripping operation.

Although the above-described thermal trip adjustability is effective, it unfortunately requires that a circuit interrupter be opened so as to provide access to internal portions thereof. This inconvenience effectively causes the adjustment to be limited to factory implemention rather than by the end user.

Because of this drawback, trip mechanisms were subsequently developed in the prior art which enabled adjustment of the thermal tripping operation without requiring the opening of a circuit interrupter. These prior art trip mechanisms include a trip bar assembly that can slide longitudinally within the housing by means of an externally controlled mechanism. The trip bar assembly includes a thermal trip member having contact portions which protrude, to differing extents, towards the bimetal. As the trip bar assembly is caused to slide, different contact portions of the thermal trip member are positioned to make contact with a deflected bimetal, thus increasing or decreasing the amount of deflection that is necessary to cause a thermal tripping operation.

Unfortunately, enabling the entire trip bar assembly to slide longitudinally within the housing can be very problematic. First, enabling the entire trip bar assembly to slide requires more room in the circuit interrupter's housing, which is contrary to the continuing industry objective mentioned above of creating a "smaller package." Second, because the trip bar assembly of a circuit interrupter typically includes members which must be properly positioned in order to interact with the operating mechanism of the circuit interrupter, and members which must be properly positioned in order to be contacted by forces generated by other tripping operations, these members must be designed to account for the sliding of the trip bar assembly, which can be very difficult to accomplish.

In view of the above, it would be advantageous if a circuit interrupter trip mechanism existed that could provide for externally-controlled adjustment of a thermal tripping operation which did not require the entire trip bar assembly to slide longitudinally within the housing.

SUMMARY OF THE INVENTION

The present invention provides a circuit interrupter that meets all of the above-identified needs.

In accordance with the present invention, a circuit interrupter is provided which includes a housing, separable main contacts within the housing, and an operating mechanism within the housing and interconnected with the separable main contacts. A trip mechanism is disposed within the housing that includes a trip bar assembly rotatable about an axis and that, when rotated, generates a tripping operation causing the operating mechanism to open the contacts. The trip bar assembly includes a trip member translatable along the axis. The trip mechanism includes a tripping actuator movable along a predetermined path of travel as a function of electrical current. The tripping actuator contacts a contact area of the trip member at a predetermined location along the predetermined path of travel of the tripping actuator and causes the trip bar assembly to rotate and generate the tripping operation upon a predetermined current threshold. When the trip member is translated along the axis, the contact area is contacted by the tripping actuator at a different location along the predetermined path of travel of the tripping actuator whereby the predetermined current threshold is changed.

This and other objects and advantages of the present invention will become apparent from a reading of the following description of the preferred embodiment taken in connection with the attached drawings.

BRIEF DESCRIPTION OF THE DRAWINGS

FIGS. 12A and 1 2B are orthogonal views of a lever which is part of the automatic trip assembly shown in FIG. 11.

DESCRIPTION OF THE PREFERRED EMBODIMENT

Figure 1:
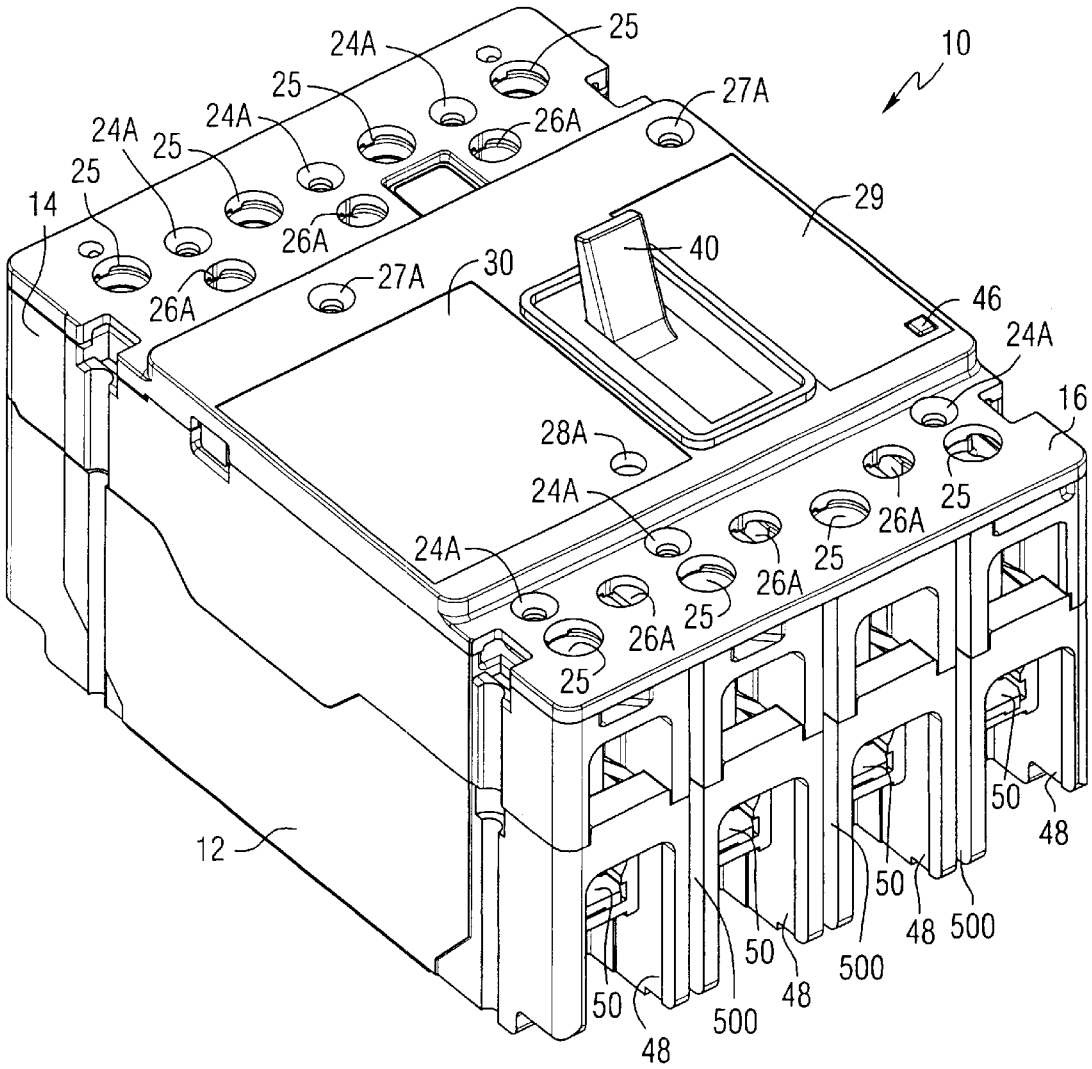
FIG. 1 is an orthogonal view of a molded case circuit interrupter embodying the present invention.
Figure 2:
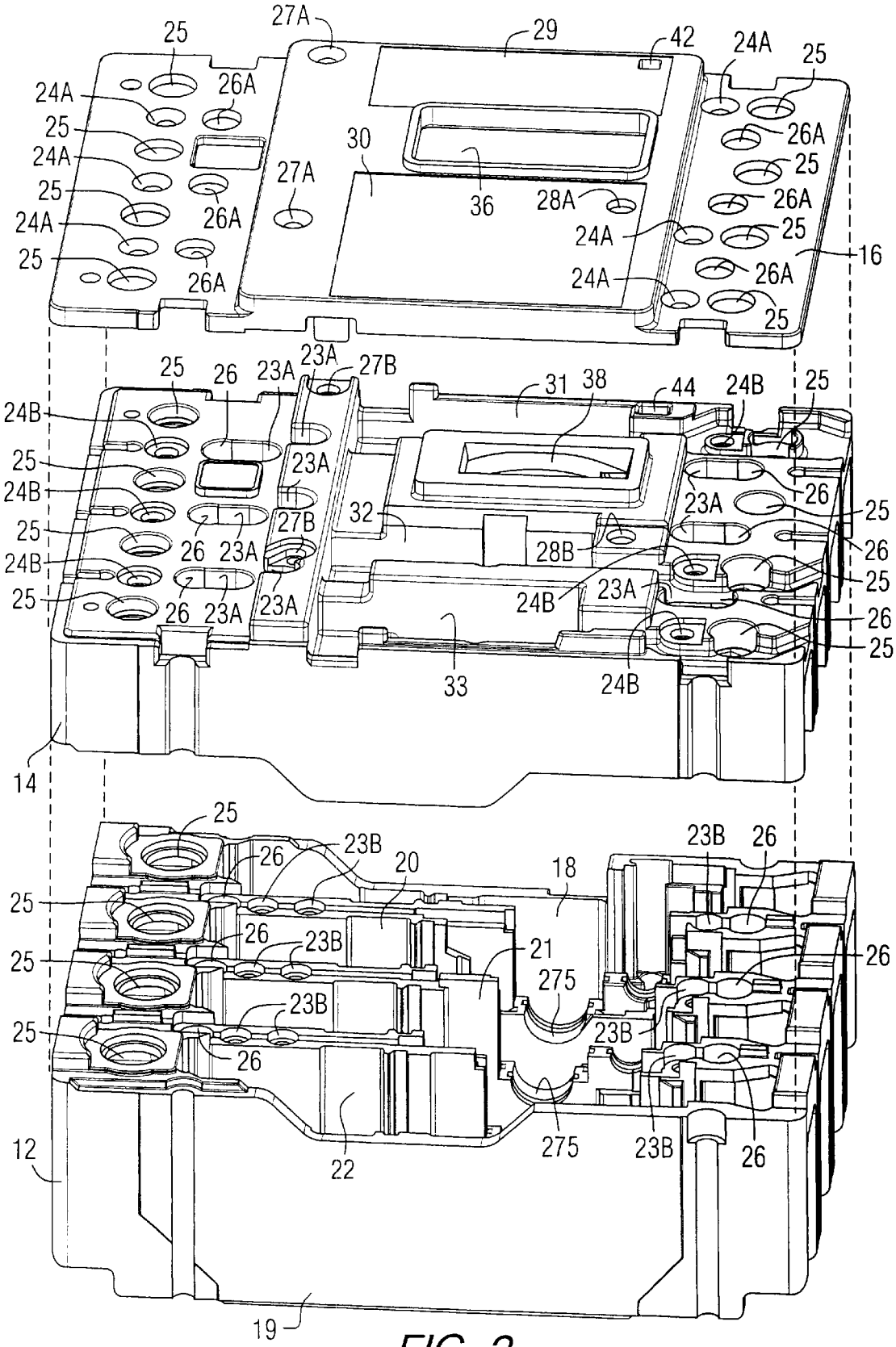
FIG. 2 is an exploded view of the base, primary cover, and secondary cover of the circuit interrupter of FIG. 1.

Referring now to the drawings and FIGS. 1 and 2 in particular, shown is a molded case circuit interrupter or breaker 10. A detailed description of the general structure and operation of circuit breaker 10 can be found in U.S. patent application Ser. No. 09/386,130, filed Aug. 30, 1999, entitled "Circuit Interrupter With Screw Retainment", U.S. patent application Ser. No. 09/384,148, filed Aug. 27, 1999, entitled "Circuit Interrupter With Cradle Having An Improved Pivot Pin Connection", U.S. patent application Ser. No. 09/505,410, filed Feb. 16, 2000, entitled "Circuit Interrupter With Improved Trip Bar Assembly Accommodating Internal Space Constraints", and U.S. patent application Ser. No. 09/665,424, Eaton Docket No. 99-PDC-433, filed Sep. 20, 2000, entitled "Circuit Interrupter With A Magnetically-Induced Automatic Trip Assembly Having Adjustable Armature Biasing", all of the disclosures of which are incorporated herein by reference. Briefly, circuit breaker 10 includes a base 12 mechanically interconnected with a primary cover 14. Disposed on top of primary cover 14 is an auxiliary or secondary cover 16. When removed, secondary cover 16 renders some internal portions of the circuit breaker available for maintenance and the like without requiring disassembly of the entire circuit breaker. Base 12 includes outside sidewalls 18 and 19, and internal phase walls 20, 21, and 22. Holes or openings 23A are provided in primary cover 14 for accepting screws or other attaching devices that enter corresponding holes or openings 23B in base 12 for fastening primary cover 14 to base 12. Holes or openings 24A are provided in secondary cover 16 for accepting screws or other attaching devices that enter corresponding holes or openings 24B in primary cover 14 for fastening secondary cover 16 to primary cover 14. Holes 27A in secondary cover 16 and corresponding holes 27B in primary cover 14 are for attachment of external accessories. Hole 28B in primary cover 14 is for insertion of an adjustment knob (not shown) for adjusting the thermal tripping operation of circuit breaker 10 in a manner described in detail below. Hole 28A in secondary cover 16 is for providing external access to the adjustment knob that is inserted in primary cover 14. Holes 25, which feed through secondary cover 16, primary cover 14, and into base 12 (one side showing holes 25), are provided for access to electrical terminal areas of circuit breaker 10. Holes 26A, which feed through secondary cover 16, correspond to holes 26 that feed through primary cover 14 and base 12, and are provided for 5 attaching the entire circuit breaker assembly onto a wall, or into a DIN rail back panel or a load center, or the like. Surfaces 29 and 30 of secondary cover 16 are for placement of labels onto circuit breaker 10. Primary cover 14 includes cavities 31, 32, and 33 for placement of internal accessories of circuit breaker 10. Secondary cover 16 includes a secondary cover handle opening 36. Primary cover 14 includes a primary cover handle opening 38. A handle 40 (FIG. 1) protrudes through openings 36 and 38 and is used in a conventional manner to manually open and close the contacts of circuit breaker 10 and to reset circuit breaker 10 when it is in a tripped state. Handle 40 may also provide an indication of the status of circuit breaker 10 whereby the position of handle 40 corresponds with a legend (not shown) on secondary cover 16 near handle opening 36 which clearly indicates whether circuit breaker 10 is ON (contacts closed), OFF (contacts open), or TRIPPED (contacts open due to, for example, an overcurrent condition). Secondary cover 16 and primary cover 14 include rectangular openings 42 and 44, respectively, through which protrudes a top portion 46 (FIG. 1) of a button for a push-to-trip actuator. Also shown are load conductor openings 48 in base 12 that shield and protect load terminals 50.

Although circuit breaker 10 is depicted as a four phase circuit breaker, the present invention is not limited to four-phase operation.

Figure 3:
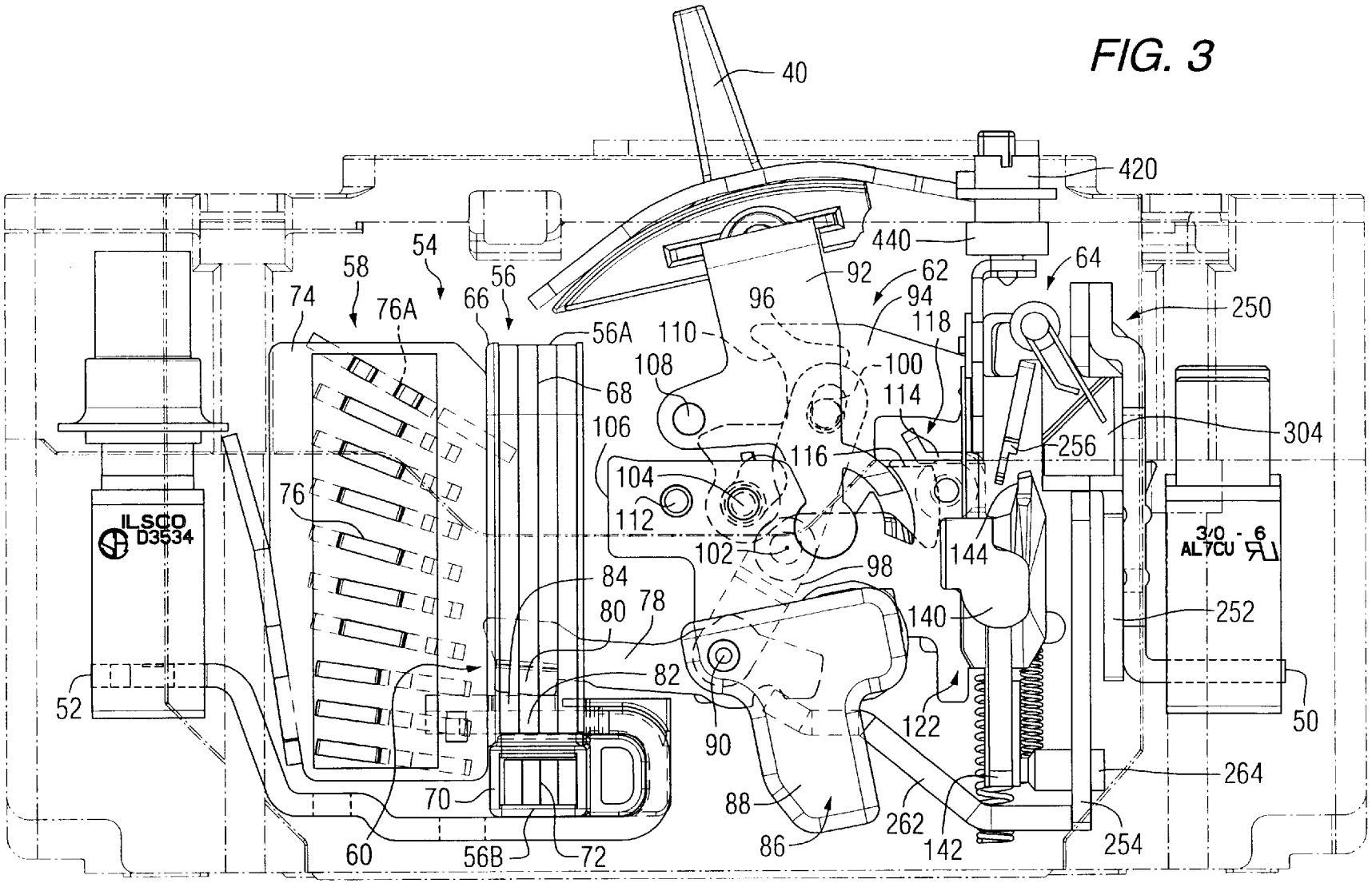
FIG. 3 is a side elevational view of an internal portion of the circuit interrupter of FIG. 1.

Referring now to FIG. 3, a longitudinal section of a side elevation, partially broken away and partially in phantom, of circuit breaker 10 is shown having a load terminal 50 and a line terminal 52. There is shown a plasma arc acceleration chamber 54 comprising a slot motor assembly 56 and an arc extinguisher assembly 58. Also shown is a contact assembly 60, an operating mechanism 62, and a trip mechanism 64 including a rotatable trip bar assembly 122. Although not viewable in FIG. 3, each phase of circuit breaker 10 has its own load terminal 50, line terminal 52, plasma arc acceleration chamber 54, slot motor assembly 56, arc extinguisher assembly 58, and contact assembly 60. Reference is often made herein to only one such group of components and their constituents for the sake of simplicity.

Each slot motor assembly 56 is shown as including a separate upper slot motor assembly 56A and a separate lower slot motor assembly 56B.

Upper slot motor assembly 56A includes an upper slot motor assembly housing 66 within which are stacked side-by-side U-shaped upper slot motor assembly plates 68. Similarly, lower slot motor assembly 56B includes a lower slot motor assembly housing 70 within which are stacked side-by-side lower slot motor assembly plates 72. Plates 68 and 72 are both composed of magnetic material.

Each arc extinguisher assembly 58 includes an arc chute 74 within which are positioned spaced-apart generally parallel angularly offset arc chute plates 76 and an upper arc runner 76A. As known to one of ordinary skill in the art, the function of arc extinguisher assembly 58 is to receive and dissipate electrical arcs that are created upon separation of the contacts of the circuit breaker.

Each contact assembly 60 is shown as comprising a movable contact arm 78 supporting thereon a movable contact 80, and a stationary contact arm 82 supporting thereon a stationary contact 84. Each stationary contact arm 82 is electrically connected to a line terminal 52, and each movable contact arm 78 is electrically connected to a load terminal 50. Also shown is a crossbar assembly 86 which traverses the width of circuit breaker 10 and is rotatably disposed on an internal portion of base 12 (not shown). Actuation of operating mechanism 62 causes crossbar assembly 86 and movable contact arms 78 to rotate into or out of a disposition which places movable contacts 80 into or out of a disposition of electrical continuity with fixed contacts 84. Crossbar assembly 86 includes a movable contact cam housing 88 for each movable contact arm 78. A pivot pin 90 is disposed in each housing 88 upon which a movable contact arm 78 is rotatably disposed. Under normal circumstances, movable contact arms 78 rotate in unison with the rotation of crossbar assembly 86 (and housings 88) as crossbar assembly 86 is rotated clockwise or counter-clockwise by action of operating mechanism 62. However, it is to be noted that each movable contact arm 78 is free to rotate (within limits) independently of the rotation of crossbar assembly 86. In particular, in certain dynamic, electromagnetic situations, each movable contact arm 78 can rotate upwardly about pivot pin 90 under the influence of high magnetic forces. This is referred to as "blow-open" operation.

Operating mechanism 62 comprises a handle arm or handle assembly 92 (connected to handle 40), a configured plate or cradle 94, an upper toggle link 96, an interlinked lower toggle link 98, and an upper toggle link pivot pin 100 which interlinks upper toggle link 96 with cradle 94. Lower toggle link 98 is pivotally interconnected with upper toggle link 96 by way of an intermediate toggle link pivot pin 102, and with crossbar assembly 86 at pivot pin 90. Provided is a cradle pivot pin 104 which is laterally and rotatably disposed between parallel, spaced apart operating mechanism support members or sideplates 106. Cradle 94 is free to rotate (within limits) via cradle pivot pin 104. Also provided is a handle assembly roller 108 which is disposed in and supported by handle assembly 92 in such a manner as to make mechanical contact with (roll against) arcuate portions of a back region 110 of cradle 94 during a "resetting" operation of circuit breaker 10. A main stop bar 112 is laterally disposed between sideplates 106, and provides a limit to the counter-clockwise movement of cradle 94.

Figure 4:
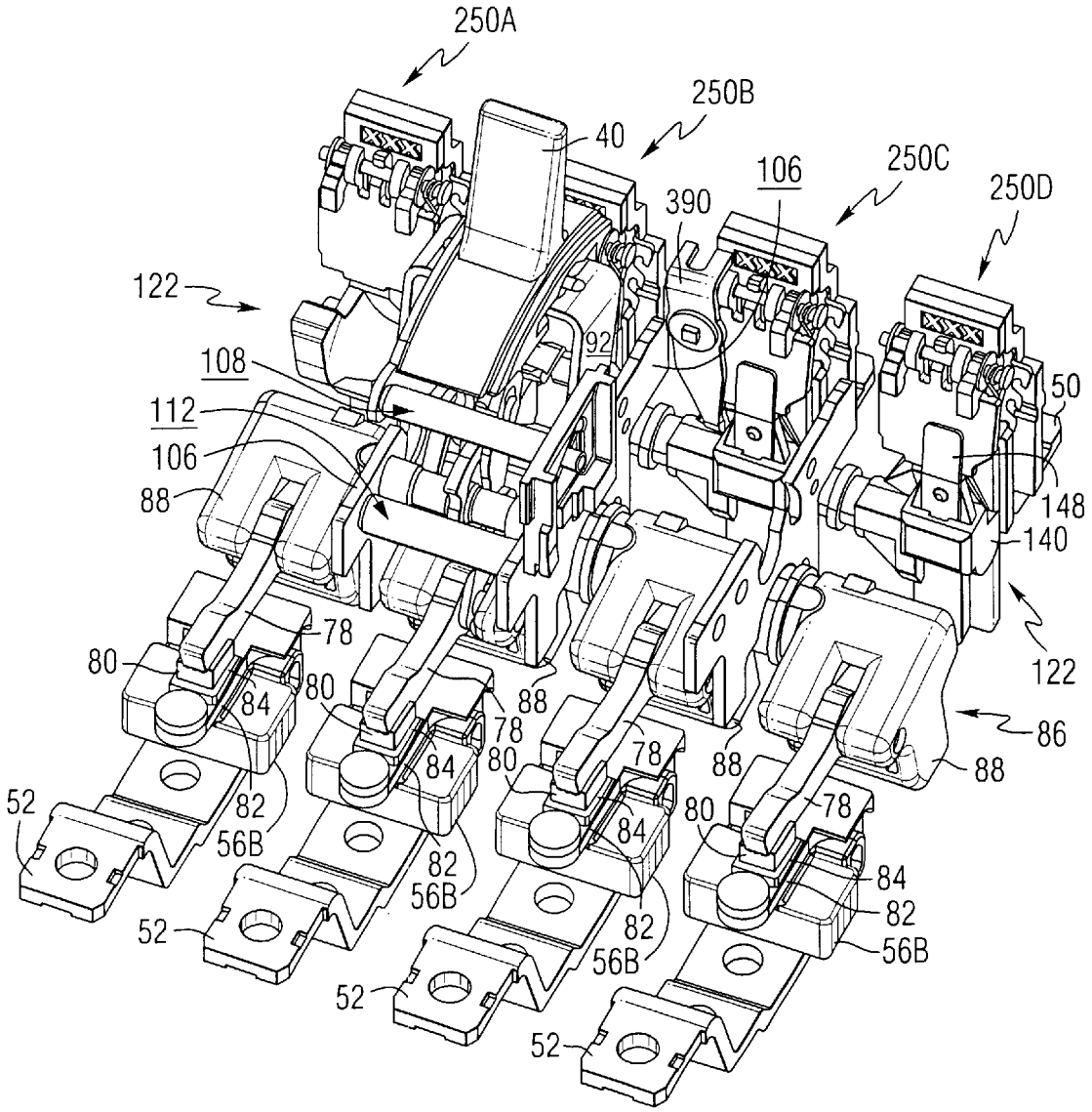
FIG. 4 is an orthogonal view of an internal portion of the circuit interrupter of FIG. 1 without the base and covers.

Referring now also to FIG. 4, shown is an orthogonal view of an internal portion of circuit breaker 10. Shown are many of the components described above in connection with FIG. 3 and their configuration in the exemplary embodiment of four phase circuit breaker 10.

In FIG. 3, operating mechanism 62 is shown for the ON disposition of circuit breaker 10. In this disposition, contacts 80 and 84 are closed (in contact with each other) whereby electrical current may flow from load terminals 50 to line terminals 52. Operating mechanism 62 will assume the TRIPPED disposition of circuit breaker 10 in certain circumstances. The TRIPPED disposition is related to an opening of circuit breaker 10 caused by a manual tripping operation, an accessory tripping operation, or the thermally or magnetically induced reaction of trip mechanism 64 to the magnitude of the current flowing between load conductors 50 and line conductors 52. The automatic opening of circuit breaker 10 due to the operation of trip mechanism 64 is described in detail below. Whatever the nature of a tripping operation, it is initiated by a force causing trip bar assembly 122 to rotate clockwise (overcoming a spring force biasing assembly 122 in the opposite direction) and away from an intermediate latch 114. This unlocking of latch 114 releases cradle 94 (which had been held in place at a lower portion 116 of a latch cutout region 118) and enables it to be rotated counter-clockwise under the influence of tension springs (not shown) interacting between the top of handle assembly 92 and the intermediate toggle link pivot pin 102. The resulting collapse of the toggle arrangement causes pivot pin 90 to be rotated clockwise and upwardly to thus cause crossbar assembly 86 to similarly rotate. This rotation of crossbar assembly 86 causes a clockwise motion of movable contact arms 78, resulting in a separation of contacts 80 and 84.

Figure 5A:
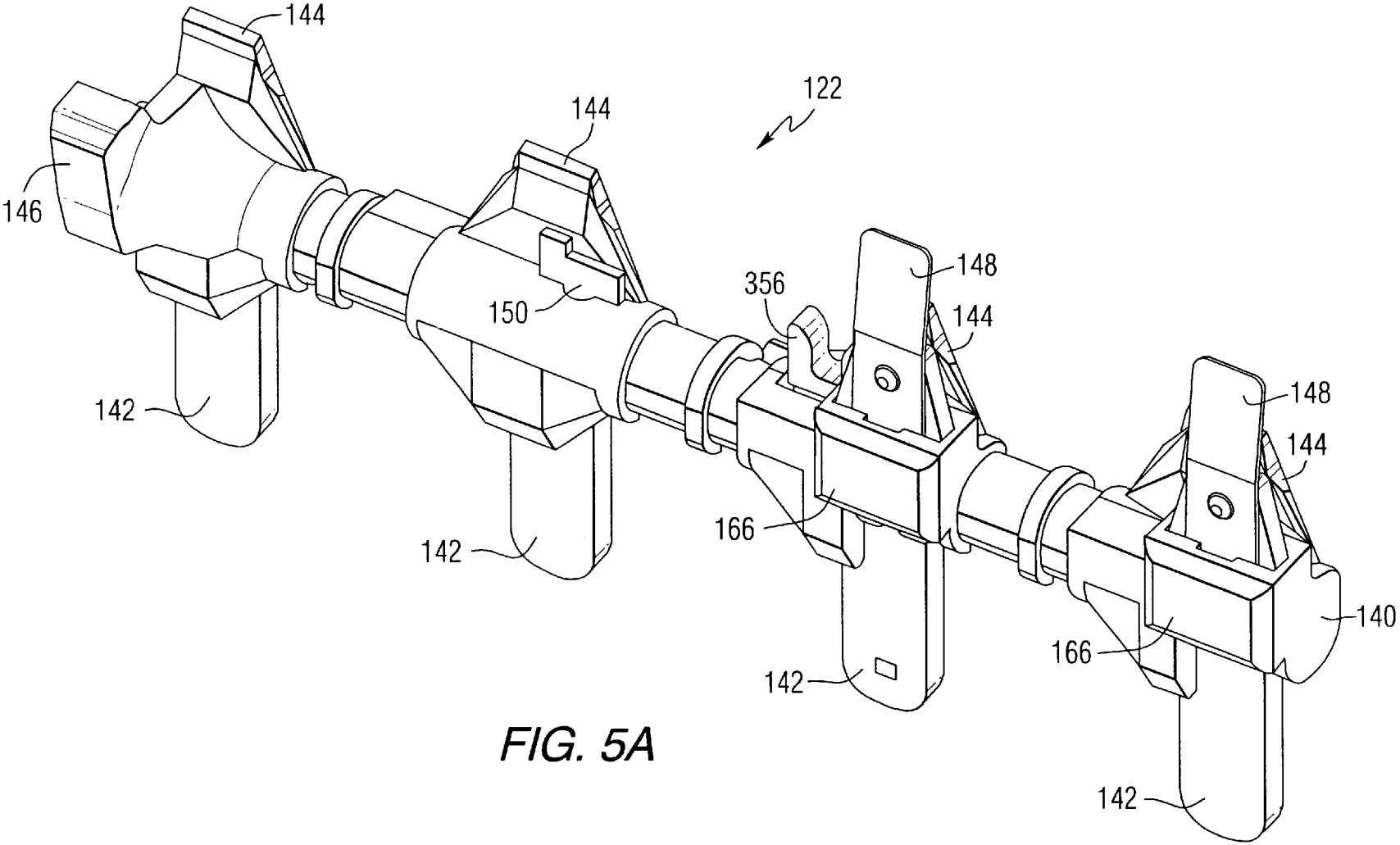
FIGS. 5A, 5B, and 5C are orthogonal views of the trip bar assembly of the circuit interrupter of FIG. 1.
Figure 5B:
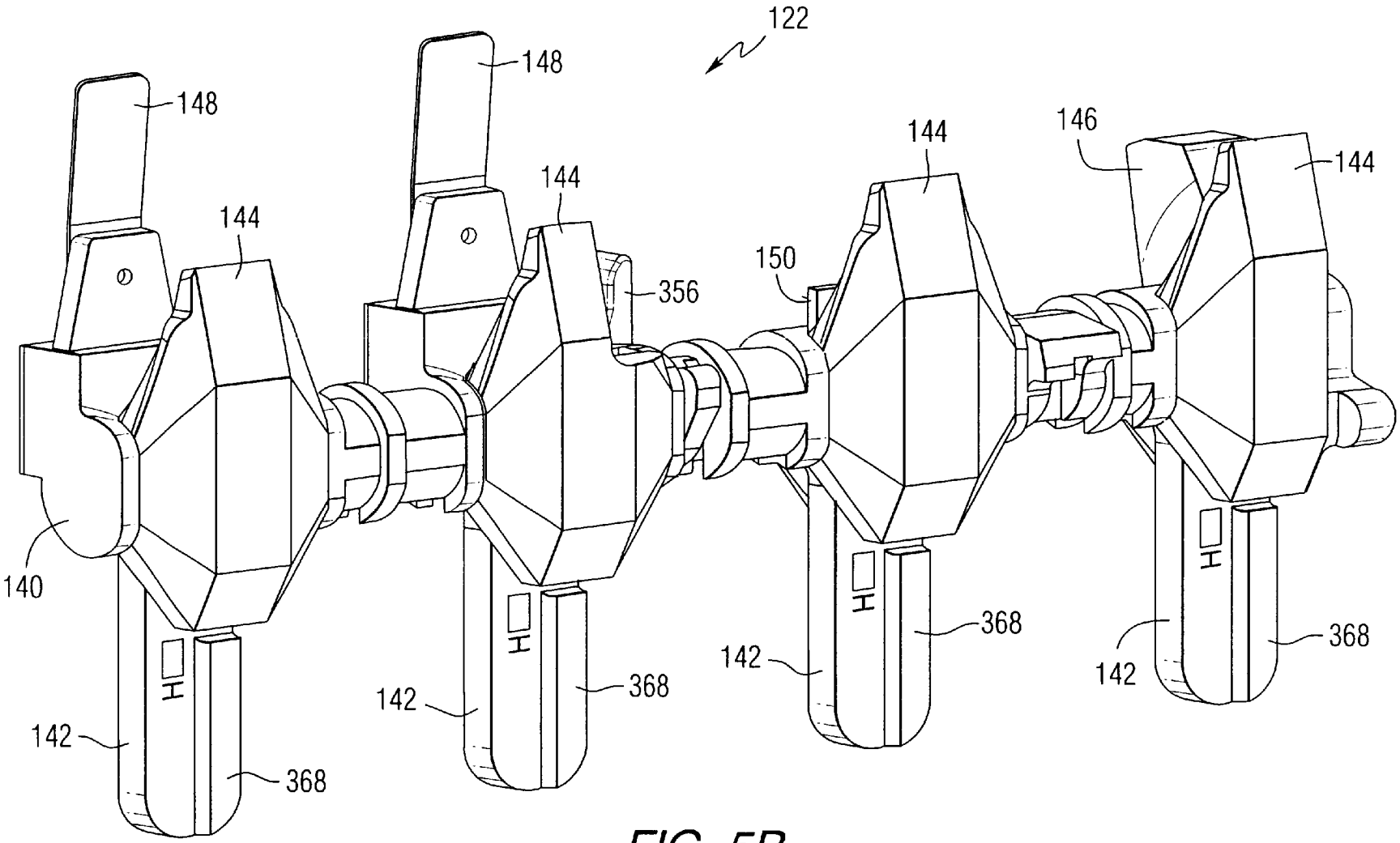
Figure 5C:
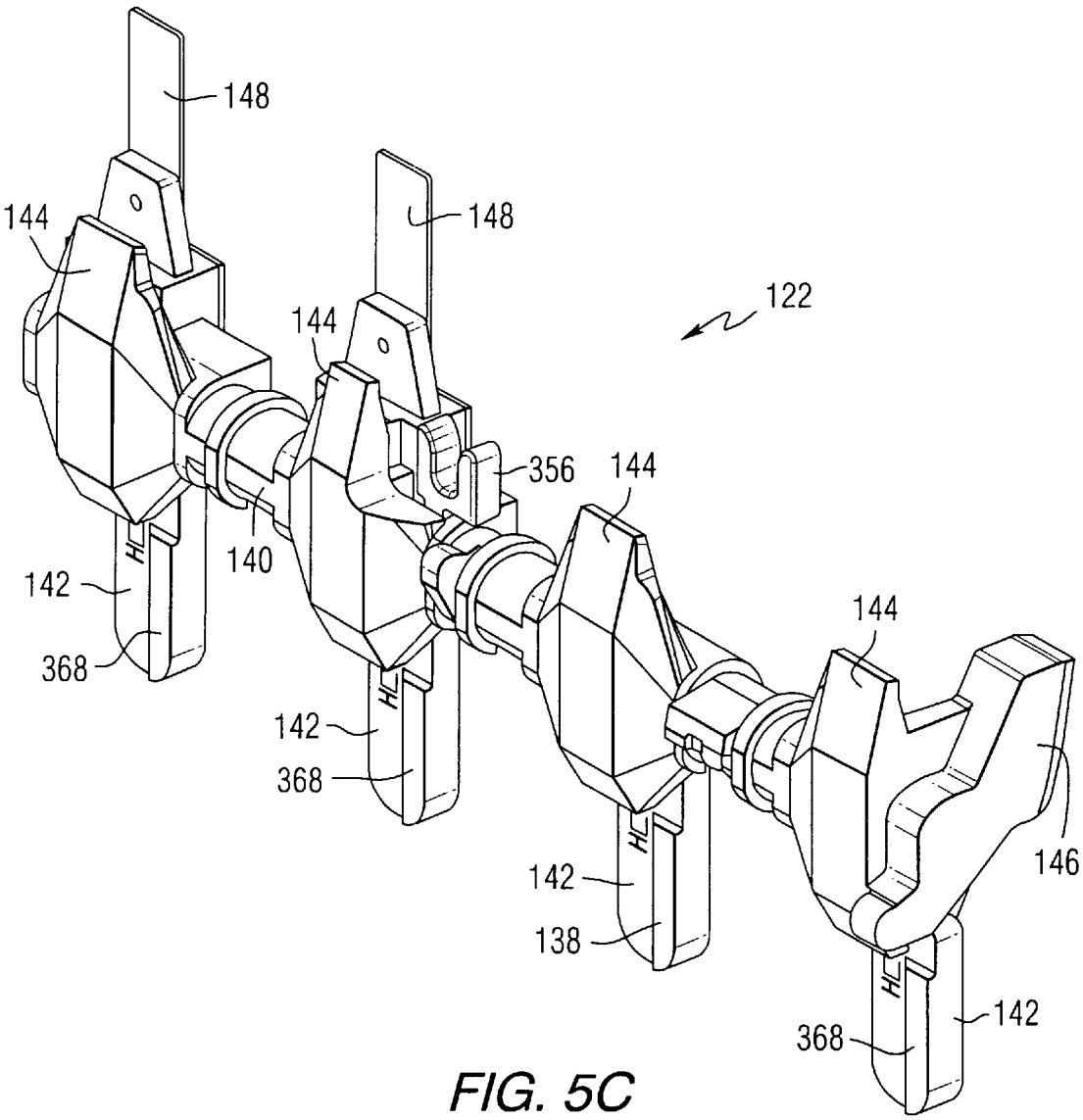

Referring now to FIGS. 5A, 5B, and 5C, shown is trip bar assembly 122 of trip mechanism 64 of the exemplary embodiment. Assembly 122 includes a trip bar or shaft 140 to which is connected thermal trip bars or paddles 142, magnetic trip bars or paddles 144, a multi-purpose trip member 146, and accessory trip levers 148 which attach to trip bar 140 by way of attaching structures 166. Trip bar assembly 122 also includes an intermediate latch interface 150 that locks with intermediate latch 114 (FIG. 3) when trip bar assembly 122 has not rotated clockwise due to a tripping operation.

Circuit breaker 10 includes automatic thermal and magnetic tripping operations which can cause trip bar assembly 122 to rotate in the clockwise direction (as viewed in FIG. 3) and thereby release cradle 94. The structure for providing these additional tripping operations can be seen in FIG. 3 which shows circuit breaker 10 in its ON (non-TRIPPED) disposition, with latch 114 abutted hard against lower portion 116 of latch cutout region 118 of cradle 94, and latch 114 held in place by intermediate latch interface 150 (FIG. 5A) of trip bar assembly 122. Also shown is an automatic trip assembly 250 of trip mechanism 64 that is positioned in close proximity to trip bar assembly 122. As shown in FIG. 4, an automatic trip assembly 250 is provided for each of the four phases of circuit breaker 10, with reference numerals 250A, 250B, 250C, and 250D used for labeling purposes. As described below, automatic trip assembly 250C is slightly different from the other automatic trip assemblies. Each assembly 250 interfaces with one of thermal trip bars 142 and one of magnetic trip bars 144 of trip bar assembly 122, as described in detail below.

Figure 6B:
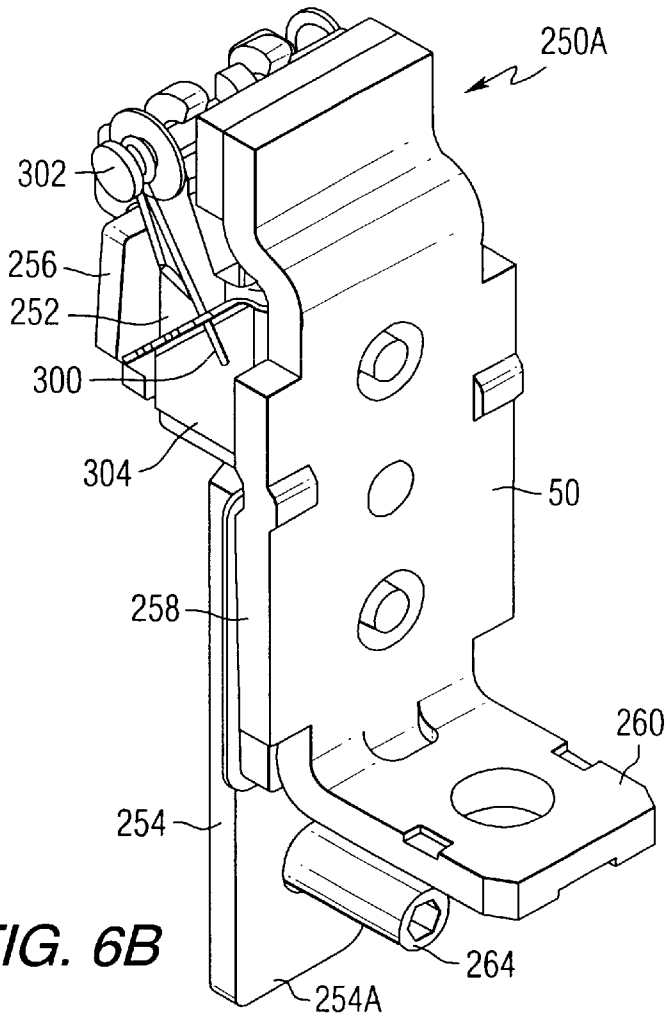
FIGS. 6A and 6B are orthogonal views of one of the automatic trip assemblies of the circuit interrupter of FIG. 1.
Figure 6A:
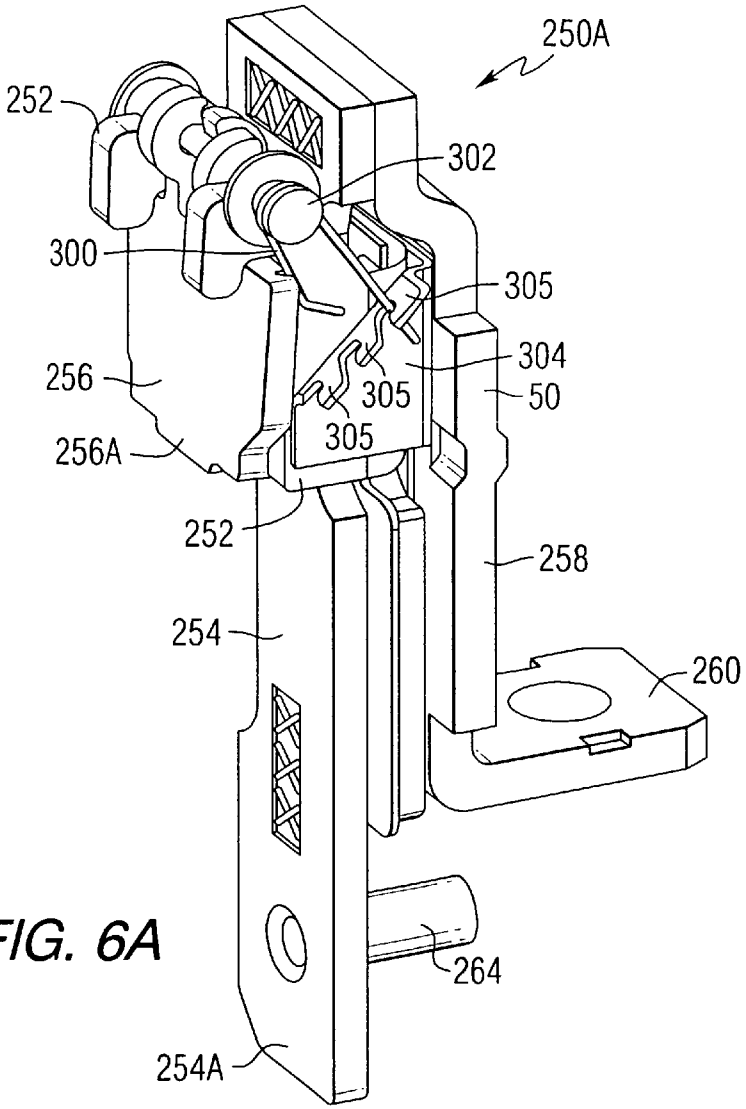

Referring now also to FIGS. 6A and 6B, shown in isolation is automatic trip assembly 250A and its various components (automatic trip assemblies 250B and 250D are identical). A thorough description of the structure and operation of automatic trip assembly 250A and its components is disclosed in U.S. patent application Ser. No. 09/665,424, Eaton Docket No. 99-PDC-433, filed Sep. 20, 2000, entitled "Circuit Interrupter With A Magnetically-Induced Automatic Trip Assembly Having Adjustable Armature Biasing", the entire disclosure of which is incorporated herein by reference. Briefly, assembly 250A includes a magnetic yoke 252, a bimetal 254, a magnetic clapper or armature 256 having a bottom 256A that is separated from yoke 252 by action of a torsion spring 300, and load terminal 50. A head portion of armature 256 is connected to a pivot pin 302 which provides for a rotatable disposition of armature 256 in relation to yoke 252.

For reasons discussed below, automatic trip assembly 250A also includes an adjustment bracket 304 having a plurality of protrusion members 305, with one end of torsion spring 300 abutted against one of protrusion members 305. Load terminal 50 includes a substantially planar portion 258 from which protrudes, in approximately perpendicular fashion, a bottom connector portion 260 for connecting with an external conductor by means of a device such as a self-retaining collar.

When implemented in circuit breaker 10 as shown in FIG. 3, an automatic trip assembly 250 (any one of automatic trip assemblies 250A, 250B, 250C, or 250D) operates to cause a clockwise rotation of trip bar assembly 122, thereby releasing cradle 94 which leads to the TRIPPED disposition, whenever overcurrent conditions exist through the phase associated with that automatic trip assembly 250. In the ON disposition as shown in FIG. 3, electrical current flows (in the following or opposite direction) from load terminal 50, through bimetal 254, from bimetal 254 to movable contact arm 78 through a conductive cord 262 that is welded therebetween, through closed contacts 80 and 84, and from stationary contact arm 82 to line terminal 52. An automatic trip assembly 250 reacts to an undesirably high amount of electrical current flowing through it, providing both a thermal and a magnetic tripping operation.

A magnetic tripping operation is provided by an automatic trip assembly 250 in the following manner. As electrical current flows through bimetal 254, a magnetic field is created in magnetic yoke 252 having a strength that is proportional to the magnitude of the current. This magnetic field generates an attractive force that has a tendency to pull bottom 256A of magnetic clapper 256 towards yoke 252 against the bias force provided by spring 300. When non-overcurrent conditions exist, the bias force provided by spring 300 prevents any substantial rotation of clapper 256. However, above a predetermined current level, a threshold level magnetic field is created that overcomes the spring tension and enables bottom portion 256A of clapper 256 to forcefully rotate counter-clockwise (as viewed in FIG. 6A) towards yoke 252. During this rotation, bottom portion 256A of clapper 256 makes contact with one of magnetic trip paddles or members 144 which, as shown in FIG. 3, is partially positioned between clapper 256 and yoke 252.

This contact moves magnetic trip member 144 to the right, thereby forcing trip bar assembly 122 to rotate in the clockwise direction. This leads to the TRIPPED disposition of circuit breaker 10. The predetermined current level that causes this magnetic tripping operation can be adjusted. Adjustment may be accomplished by implementation of a different sized (wire diameter) or configured torsion spring 300, or one of different material, thereby reducing or increasing the spring tension. However, in a manner described in detail in U.S. patent application Ser. No. 09/665,424, Eaton Docket No. 99-PDC-433, filed Sep. 20, 2000, entitled "Circuit Interrupter With A Magnetically-induced Automatic Trip Assembly Having Adjustable Armature Biasing", adjustment is more conveniently made by selecting a different protrusion member 305 against which the one end of torsion spring 300 abuts.

An automatic trip assembly 250 also provides a thermal tripping operation. The thermal tripping operation of an automatic trip assembly 250 is attributable to the reaction of bimetal 254 to current flowing therethrough. The temperature of bimetal 254 is proportional to the magnitude of the electrical current. As current magnitude increases, the heat buildup in bimetal 254 has a tendency to cause a bottom portion 254A (see FIGS. 6A and 6B) to deflect (bend) to the left (as viewed in FIG. 3). When non-overcurrent conditions exist, this deflection is minimal. However, above a predetermined current level, the temperature of bimetal 254 will exceed a threshold temperature whereby the deflection of bimetal 254 causes bottom portion 254A to make contact with one of thermal trip bars or members 142 of trip bar assembly 122. This contact forces assembly 122 to rotate in the clockwise direction, thereby releasing cradle 94 which leads to the TRIPPED disposition. As with the magnetic tripping operation, the predetermined current level (overcurrent) that causes this thermal tripping operation can be adjusted in a conventional manner by changing the size and/or shape of bimetal 254. Furthermore, adjustment can be made by selectively screwing a screw 264 (see FIGS. 6A and 6B) through an opening in bottom portion 254A such that it protrudes to a certain extent through the other side (towards thermal trip member 142). Protruding as such, screw 264 is positioned to more readily contact thermal trip member 142 (and thus rotate assembly 122) when bimetal 254 deflects, thus selectively reducing the amount of deflection that is necessary to cause the thermal tripping operation.

Figure 7:
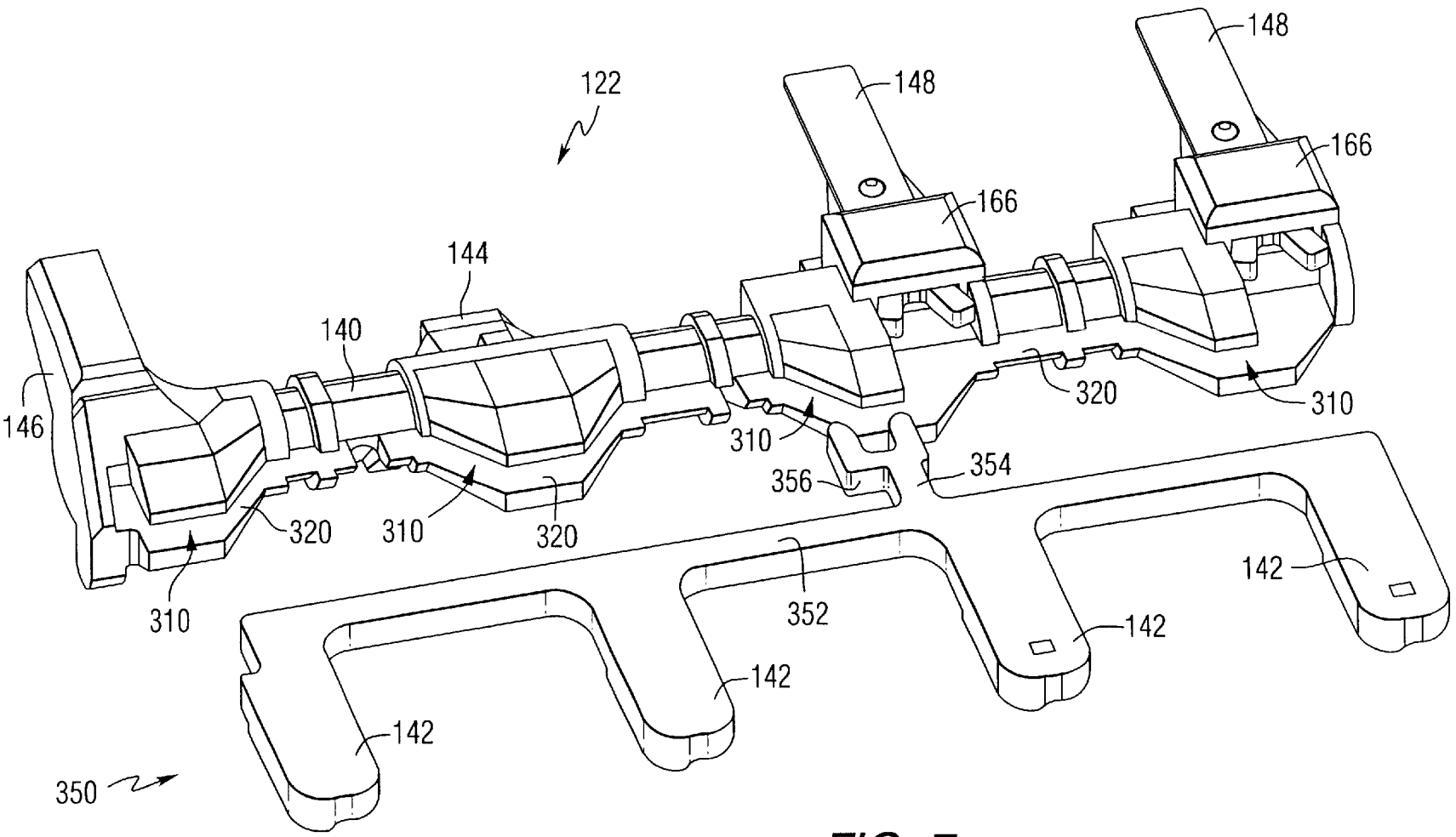
FIG. 7 is an orthogonal view of the trip bar assembly of FIGS. 5A, 5B, and 5C with the thermal trip slider removed.
Figure 8:
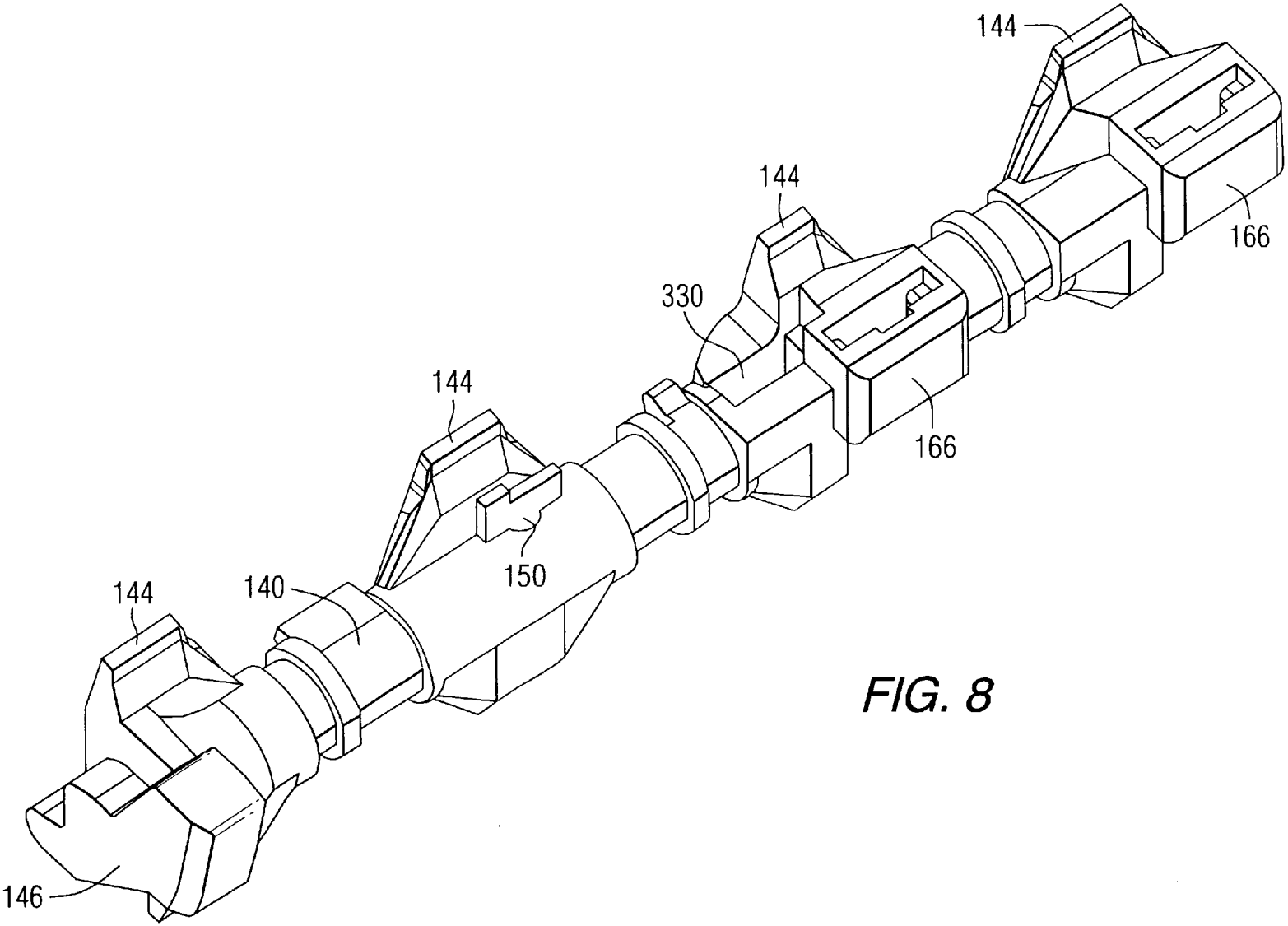
FIG. 8 is an orthogonal view of the trip bar of the trip bar assembly of FIGS. 5A, 5B, and 5C.
Figure 9:
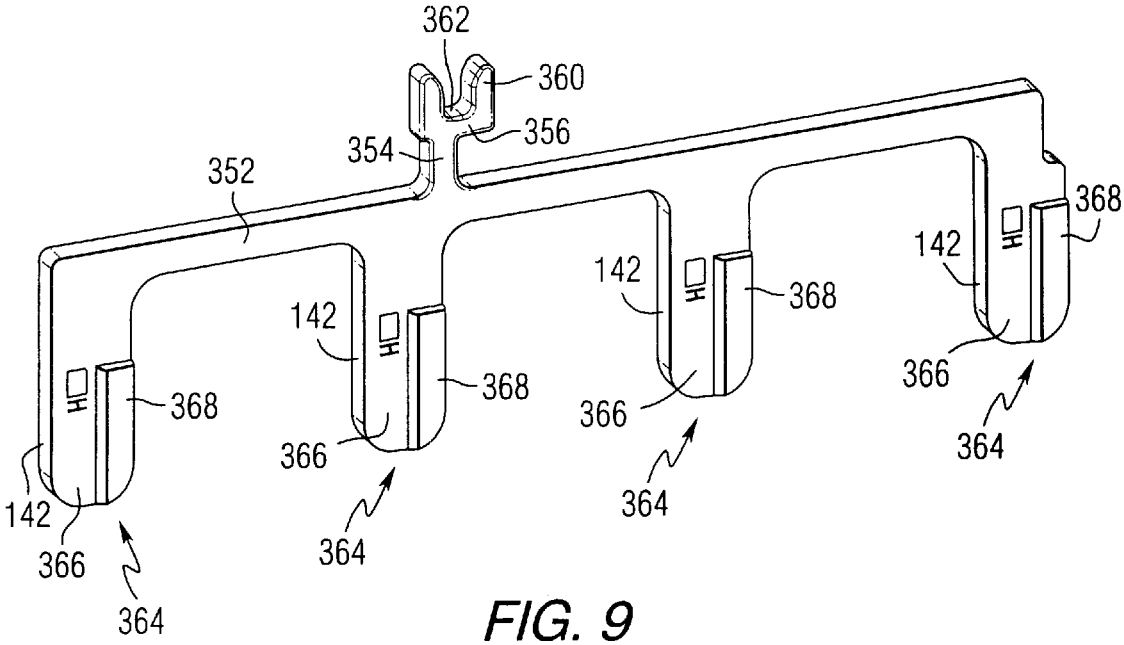
FIG. 9 is an orthogonal view of the thermal trip slider of the trip bar assembly.

The present invention provides yet another method of adjustment of the thermal tripping operation and, in particular, one which is externally controlled. Referring now to FIG. 7, shown is trip bar assembly 122 in a partially disassembled state. In particular, thermal trip members 142 are shown removed from trip bar 140. Members 142 are attached to a bar 352, forming a thermal trip slider 350 that is removable from a recess or cavity 310 within trip bar 140 when trip bar 140 is removed from base 12 (housing portions 275 shown in FIG. 2 abut against the bottom of trip bar 140 and prevent thermal trip slider 350 from falling out of recess 310 when circuit breaker 10 is in its assembled state). As shown in FIG. 7, recess 310 is accessible by way of an opening 320 running lengthwise along the underside of trip bar 140, and by way of a more limited opening 330 located on the top of trip bar 140 as shown in FIG. 8 (wherein accessory trip levers 148 have been removed for the sake of clarity). Referring now also to FIG. 9, wherein the reverse side of thermal trip slider 350 is shown, thermal trip slider 350 includes a neck 354 attached to bar 352 and which leads to a head portion 356 including a first prong 358 and a second prong 360 forming a recess 362. As described in more detail below, each thermal trip member 142 includes a contact region 364 on the side of thermal trip slider 350 shown in FIG. 9, including a non-raised portion 366 and a raised portion 368. In the exemplary embodiment, trip bar 140 and thermal trip slider 350 are each formed of thermoset plastic material.

Figure 10A:
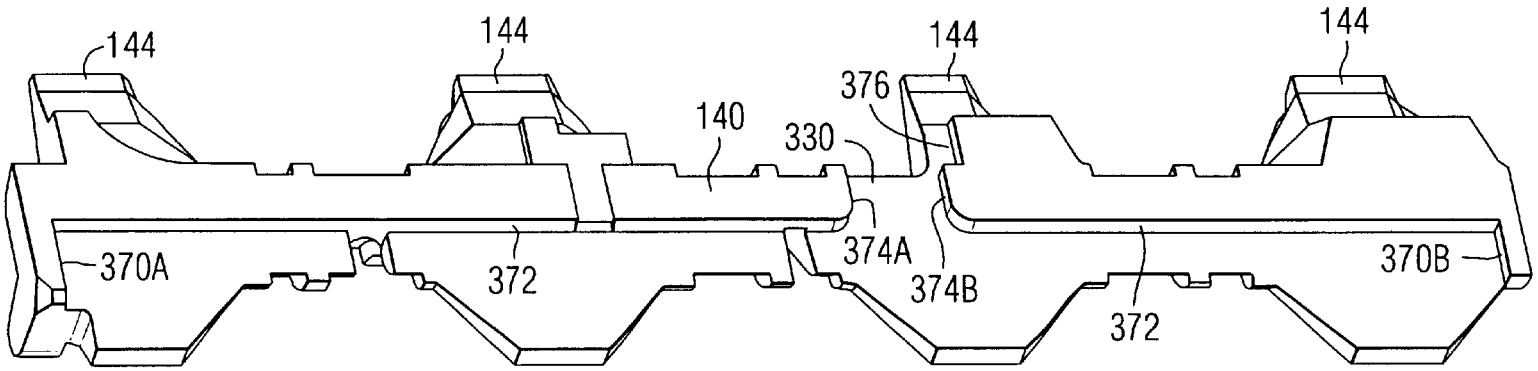
FIG. 10A is an orthogonal cut-away view of the trip bar of the trip bar assembly.
Figure 10B:
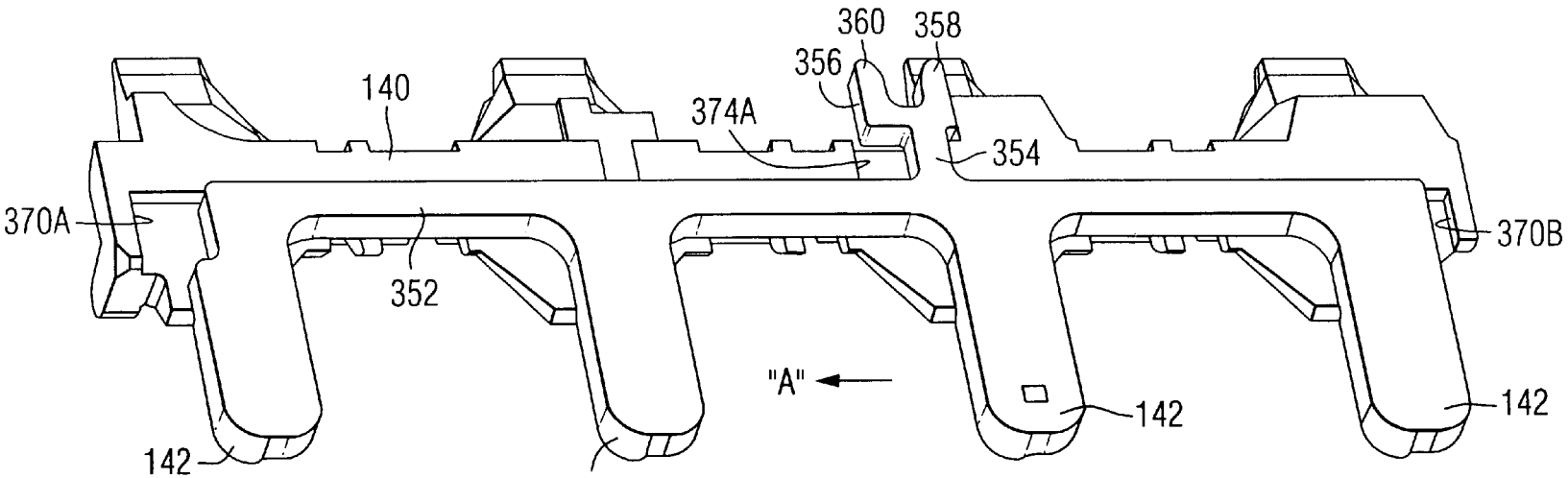
FIG. 10B is a view similar to that shown in FIG. 10A but with the thermal trip slider inserted.

Referring now to FIG. 10A, shown is a partially cut-away view of trip bar 140 showing the internal structure of recess 310. Recess 310 is shown bounded by sidewalls 370A and 370B, an upper wall 372, and neck sidewalls 374A and 374B which lead to opening 330. Also shown is a cutout 376 in trip bar 140 that is adjacent to opening 330. Referring now also to FIG. 10B, shown is the partially cut-away view of trip bar 140 of FIG. 10A with thermal trip slider 350 in its assembled position therein. As shown, the top of bar 352 of slider 350 abuts against upper wall 372, with neck 354 positioned between neck sidewalls 374 and head portion 356 protruding out of opening 330. In the position of thermal trip slider 350 shown in FIG. 10B, neck 354 abuts against neck sidewall 374B, with cutout 376 providing clearance for prong 358 of head portion 356. In addition, thermal trip slider 350 is close to abutting sidewall 370B of trip bar 140, although contact is not made in the exemplary embodiment. As can be appreciated, thermal trip slider 350 can be moved, or slid, in the direction of the arrow labeled "A" until neck 354 abuts against neck sidewall 374A, at which time slider 350 will also be close to abutting sidewall 370A. The range of motion of thermal trip slider 350 within trip bar 140 is equal to the distance between neck sidewalls 374A and 374B minus the thickness of neck 354 of slider 350. This range of motion provides for adjustability of the thermal tripping operation in a manner described below.

Figure 11:
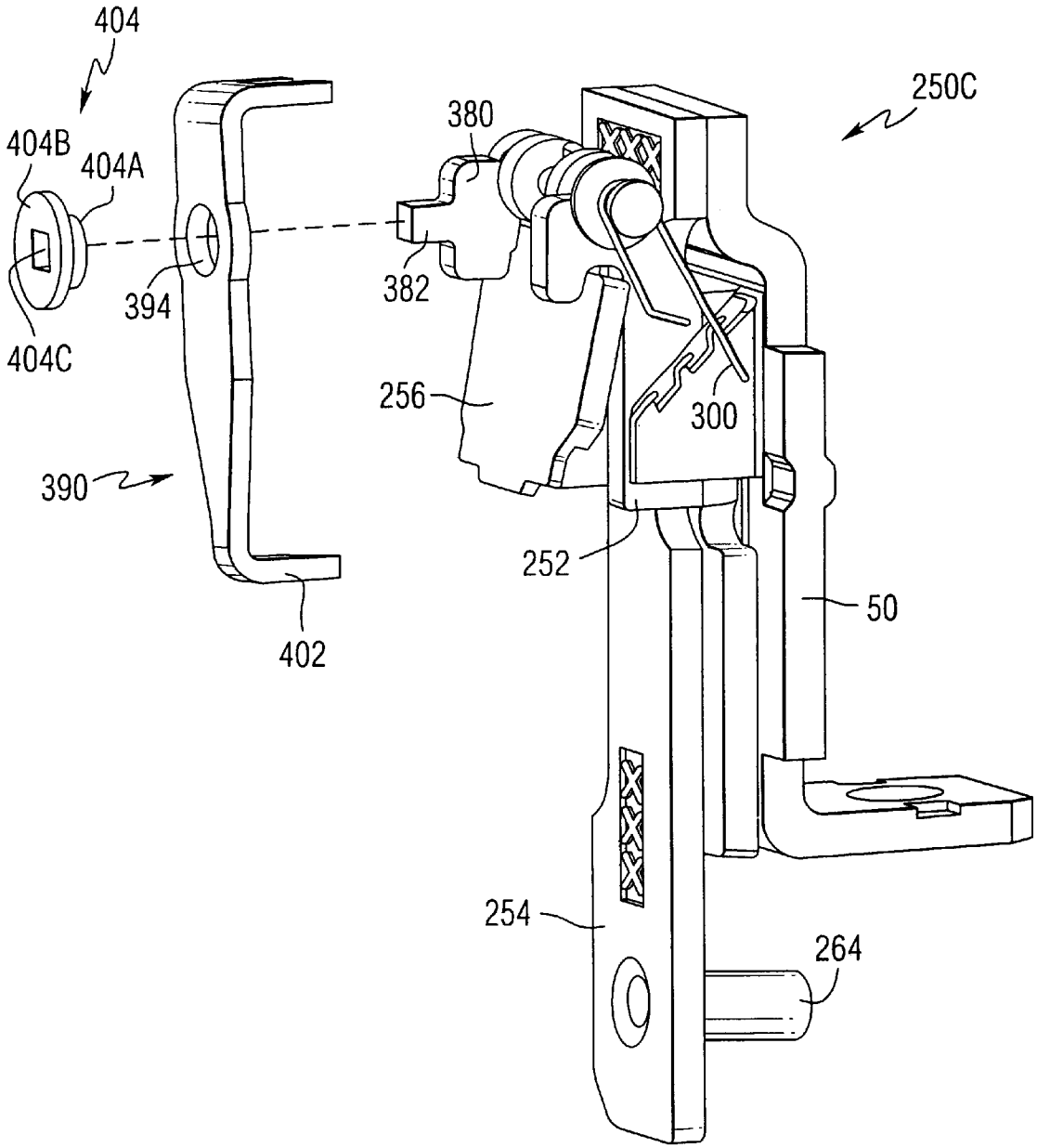
FIG. 11 is a partially exploded view of one of the automatic trip assemblies of the circuit interrupter of FIG. 1.

Referring now to FIG. 11, shown is a partially exploded view of automatic trip assembly 250C of circuit breaker 10. As mentioned above, assembly 250C is slightly different from automatic trip assemblies 250A, 250B, and 250D (shown collectively in FIG. 4). In particular, yoke 252 of assembly 250C includes a pivot support 380 that is configured differently from its counterparts in the other automatic trip assemblies. Pivot support 380 is thicker and protrudes to a greater extent away from the other components of automatic trip assembly 250C. Pivot support 380 also includes a horizontallyextending protrusion 382 which, in the exemplary embodiment, is square in cross-section. Automatic trip assembly 250C also includes an adjustment or actuating lever 390 and a bushing 404.

Figure 12A:
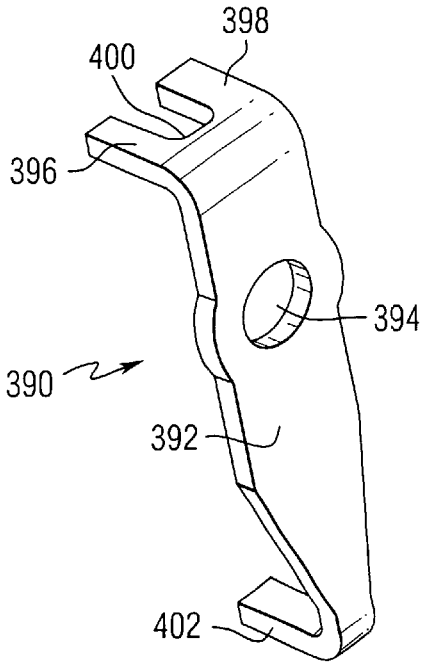
Figure 12B:
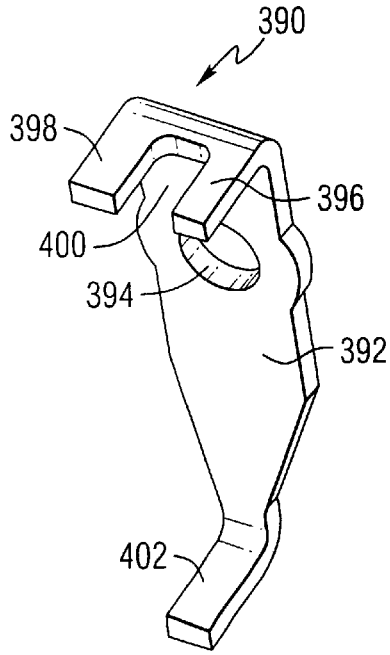

Referring now also to FIGS. 12A and 12B, lever 390 includes a main body 392 with a circular opening 394 therethrough. The top of lever 390 is bent at an approximately 90 degree angle and includes a first prong 396 and a second prong 398 between which is formed a recess 400. The bottom of lever 390 is tapered and is bent at an approximately 90 degree angle to form an arm 402. As shown in FIG. 11, in assembling automatic trip assembly 250C, a rounded body portion 404A of bushing 404 is inserted into rounded opening 394 of lever 390 until the inner surface of a head portion 404B of bushing 404 is contacted. Protrusion 382 of yoke 252 is then inserted into an opening or channel 404C extending through bushing 404, after which the end portion of protrusion 382 protruding through channel 404C is spin pressed in order to retain bushing 404 (and therefore lever 390) on protrusion 382.

Figure 17A:
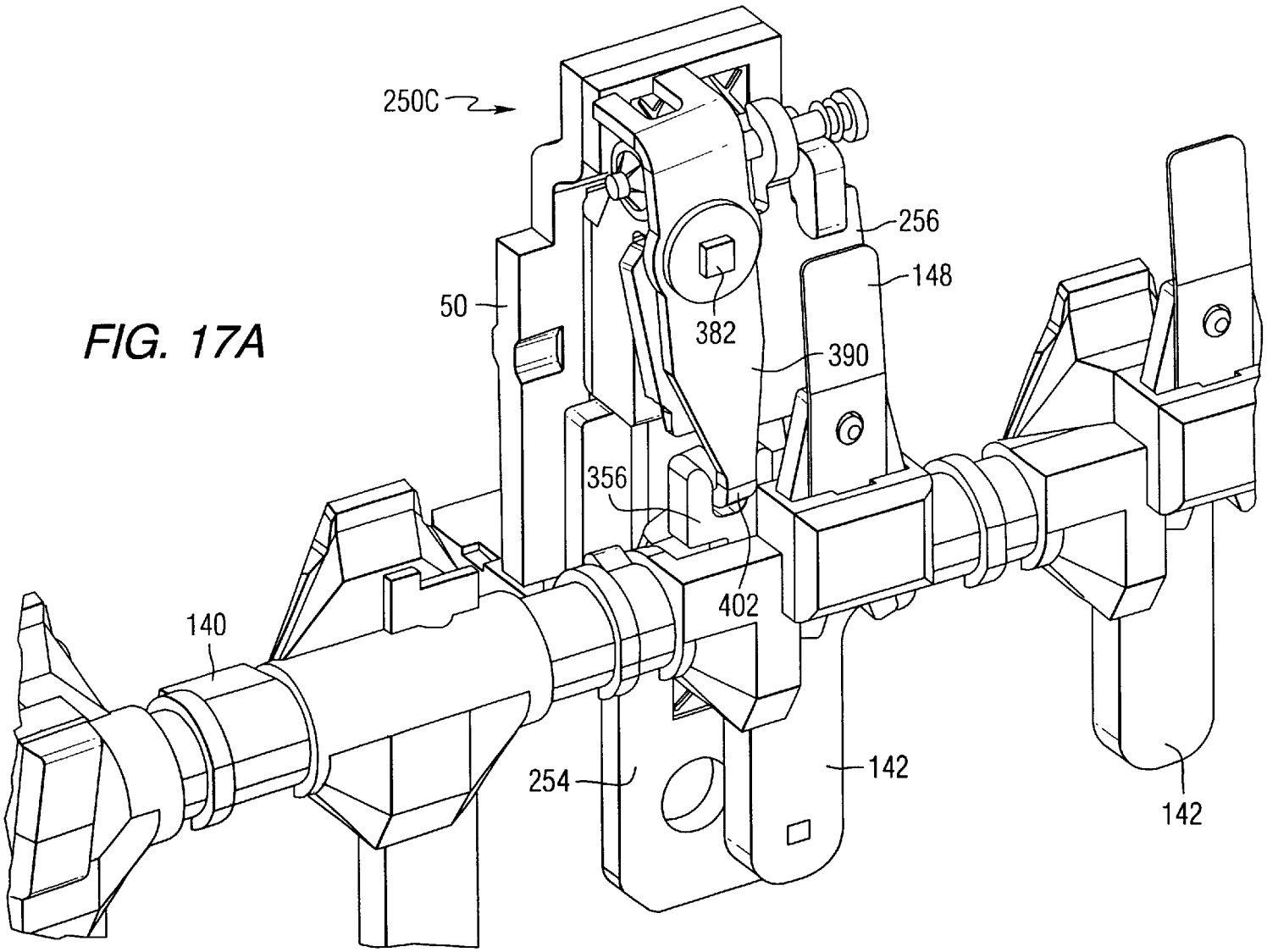
FIGS. 17A and 17B are orthogonal views of the interaction of the automatic trip assembly shown in FIG. 11 with the trip bar assembly shown in FIGS. 5A, 5B, and 5C.
Figure 17B:
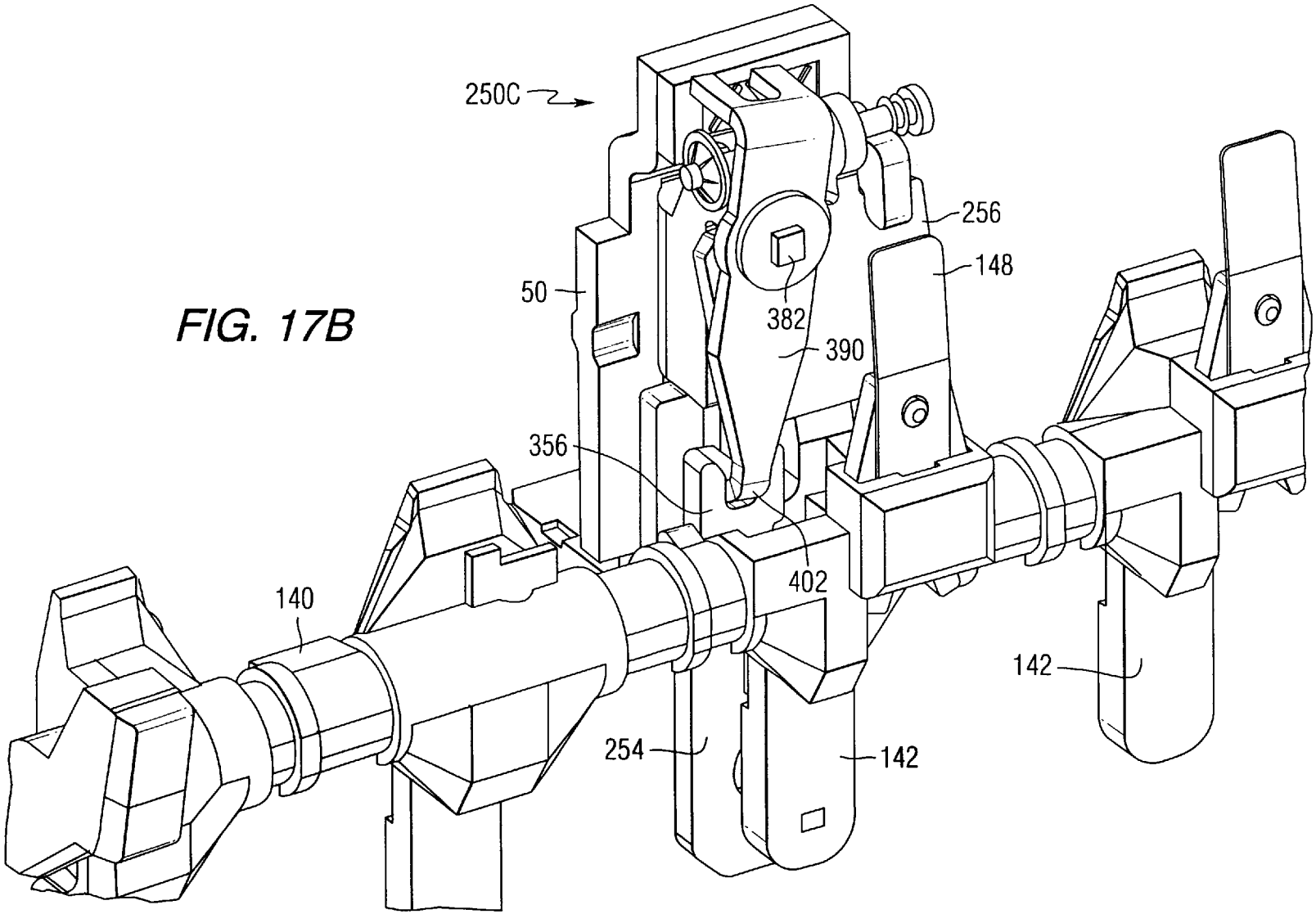

Positioned as such, lever 390 is capable of rotation, with protrusion 382 serving as the pivot axis and rounded body portion 404A of bushing 404 serving as the bearing surface. With pivot support 380 protruding to a greater extent away from the other components of assembly 250C, lever 390 can rotate without the possibility of interfering with those other components, most notably armature 256. A fully assembled automatic trip assembly 250C is shown in FIG. 4 and FIGS. 17A and 17B. In the exemplary embodiment, lever 390 is formed of metal and bushing 404 is formed of thermoplastic material.

Figure 13:
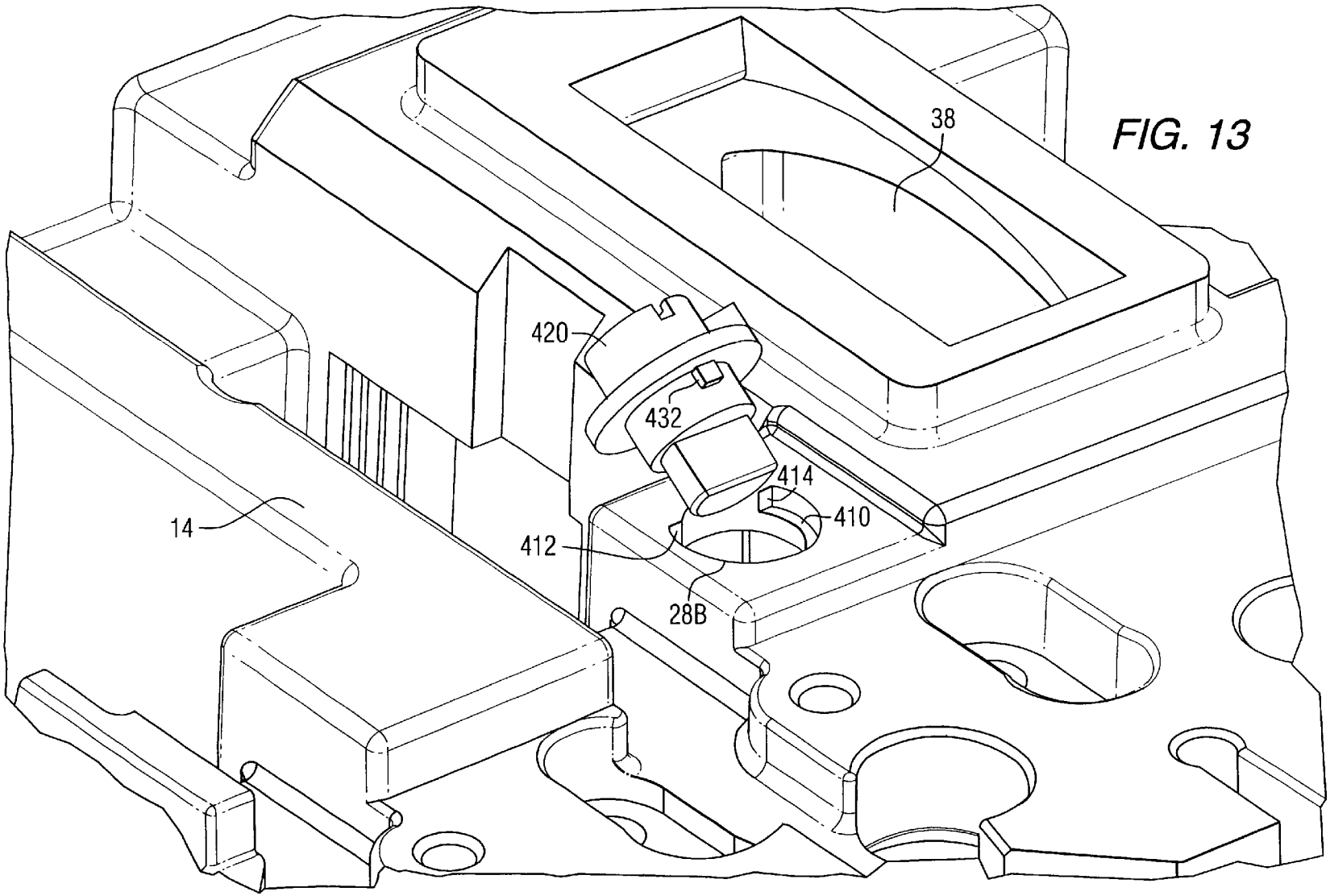
FIG. 13 is an overhead close-up view of a portion of the primary cover 10 of the circuit interrupter of FIG. 1 showing how an adjustment knob is inserted.

Referring now to FIG. 13, shown is primary cover 14 and hole 28B extending therethrough. Hole 28B is shown as including a ledge 410 that extends substantially around the circumference thereof and which terminates at stops 412 and 414. Also shown is an adjustment knob 420 which inserts into hole 28B.

Figure 14A:
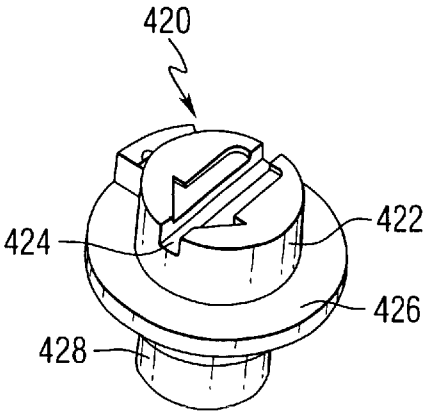
FIGS. 14A, 14B, and 14C are orthogonal views of the adjustment knob shown in FIG. 13.
Figure 14B:
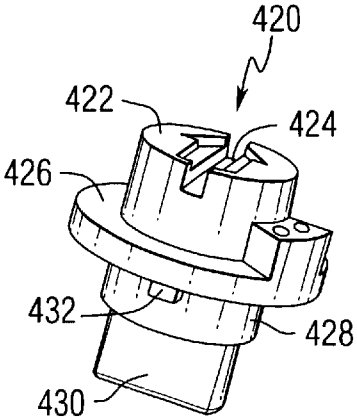
Figure 14C:
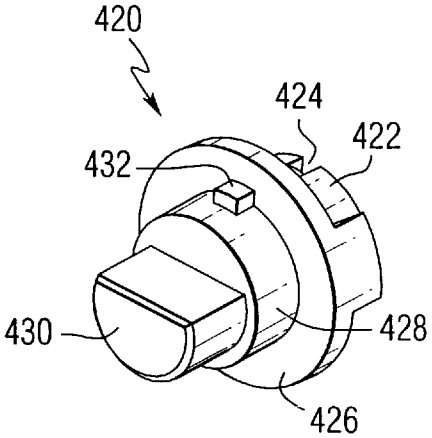

Referring now also to FIGS. 14A, 14B, and 14C, adjustment knob 420 includes a rounded top 422 having a slot 424, a circular middle plate 426, and a rounded bottom 428 from which protrudes a semi-circular protrusion 430. Positioned between bottom 428 and middle plate 426 is an abutment member 432. When adjustment knob 420 is inserted into hole 28B of primary cover 14, semi-circular protrusion 430 protrudes beneath a bottom surface (not shown) of primary cover 14. In addition, middle plate 426 makes abutting contact with the top surface of primary cover 14 that is adjacent to hole 28B, and abutment member 432 is situated in contact with ledge 410. Positioned as such, adjustment knob 420 may be rotated by way of a tool such as a screwdriver inserted into slot 424, whereby abutment member 432 abuts against stops 412 and 414 at the two extremes of the range of rotation.

Figure 15A:
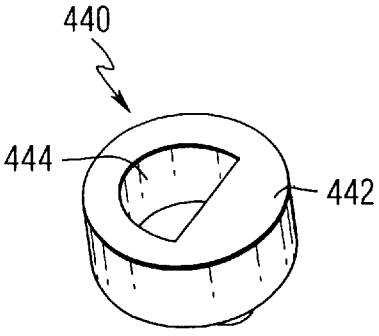
FIGS. 15A and 15B are orthogonal views of a connection member that interconnects with the adjustment knob.
Figure 15B:
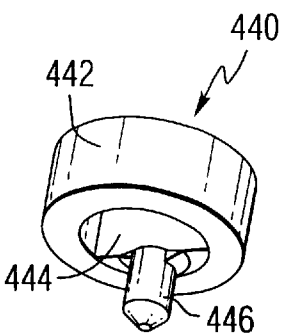

Referring now also to FIGS. 15A and 15B, shown is a connection member 440. Connection member 440 includes a rounded body 442 with an opening 444 extending therethrough having a semi-circular shape that corresponds to the shape of protrusion 430 of adjustment knob 420. Extending from the bottom of body 442 is a cylindrical protrusion 446 which, in the exemplary embodiment, includes a rounded point at its end. For reasons discussed below, protrusion 446 is not centered in the bottom of body 442.

After adjustment knob 420 is inserted into hole 28B as described above, connection member 440 is matingly attached in press fit fashion to semi-circular protrusion 430 of knob 420 (which protrudes beneath a bottom surface of primary cover 14), with protrusion 430 inserting into opening 444.

Figure 16:
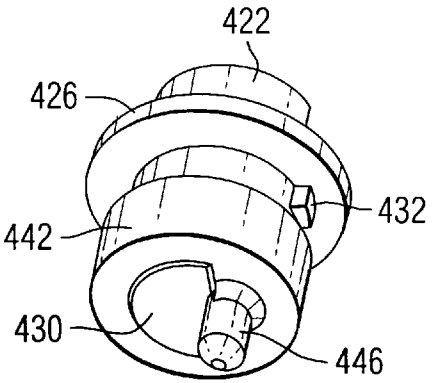
FIG. 16 is an orthogonal view of the interconnection of the connection member with the adjustment knob.

The resulting interconnection is shown in FIG. 16 where primary cover 14 (normally positioned therebetween) is not shown for the sake of illustration. The diameter of connection member 440 is large enough such that it will abut the aforementioned bottom surface of primary cover 14 and prevent adjustment knob 420 from being removed upwardly out of hole 28B. When adjustment knob 420 is rotated in the manner described above, connection member 440 will likewise rotate. In the exemplary embodiment, adjustment knob 420 and connection member 440 are formed of thermoplastic material.

Referring now to FIGS. 17A and 17B, and again to FIG. 4, in an assembled trip mechanism 64 of circuit breaker 10, lever 390 of automatic trip assembly 250C is positioned such that arm 402 thereof is positioned between prongs 358 and 360 and within recess 362 of head portion 356 of thermal trip slider 350 (the other automatic trip assemblies are not shown for the sake of clarity). When primary cover 14 is situated on top of base 12 of circuit breaker 10, the interconnection of adjustment knob 420 and connection member 440 is positioned above lever 390 of automatic trip assembly 250C.

Figure 18A:
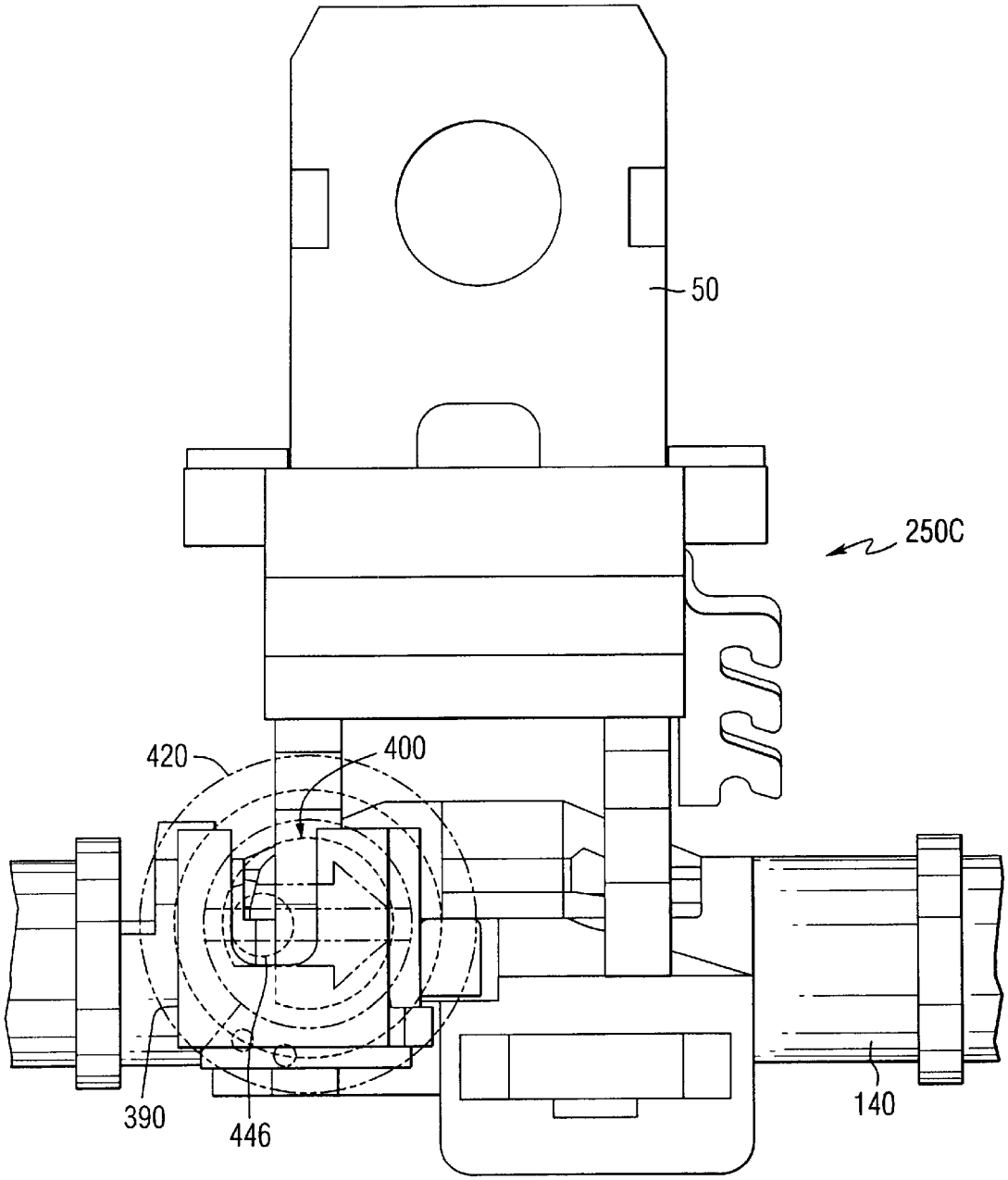
FIGS. 18A, 18B, and 18C are overhead views of the interaction of the lever of the automatic trip assembly shown in FIG. 11 with the assembly shown in FIG. 16.
Figure 18B:
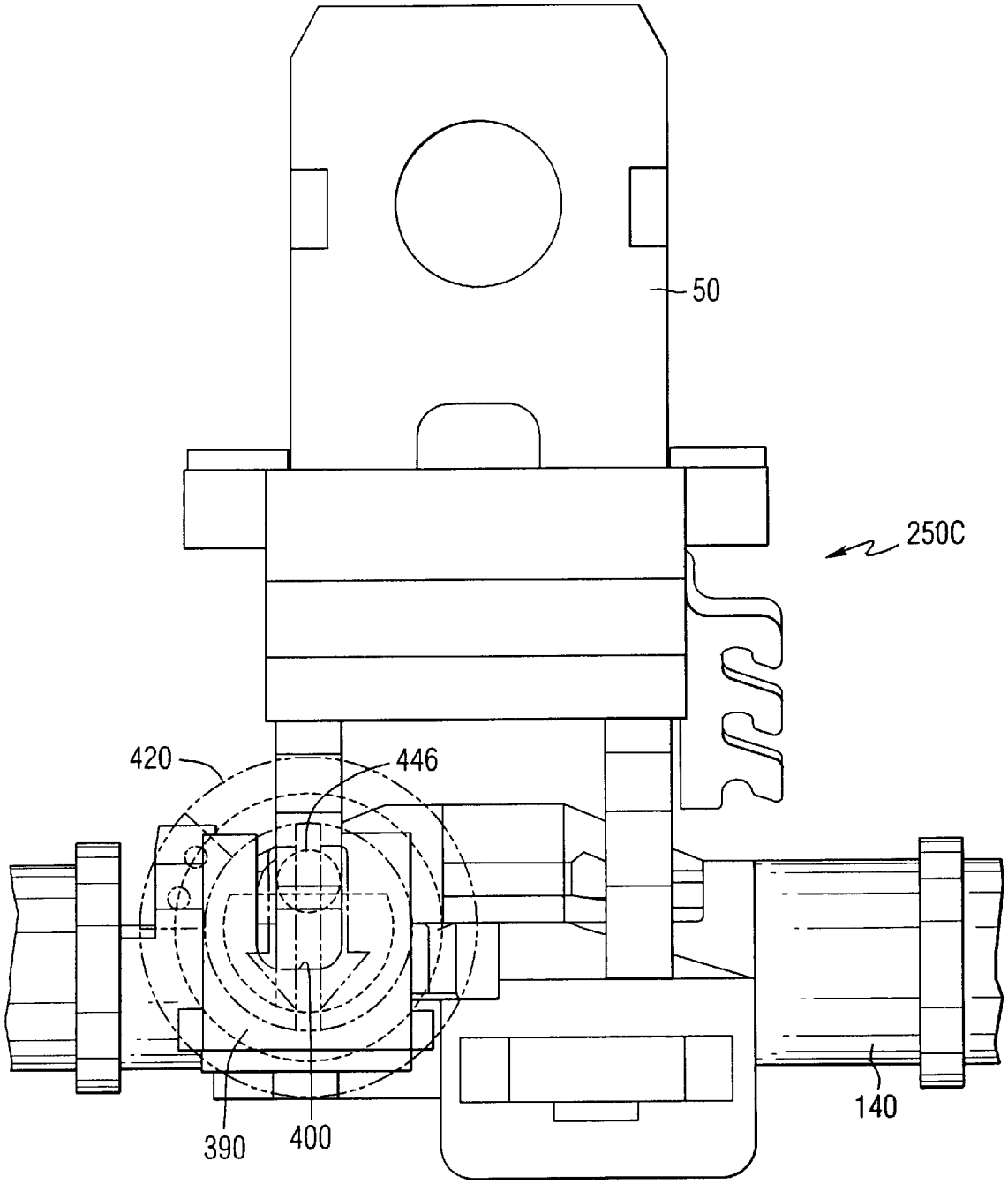
Figure 18C:
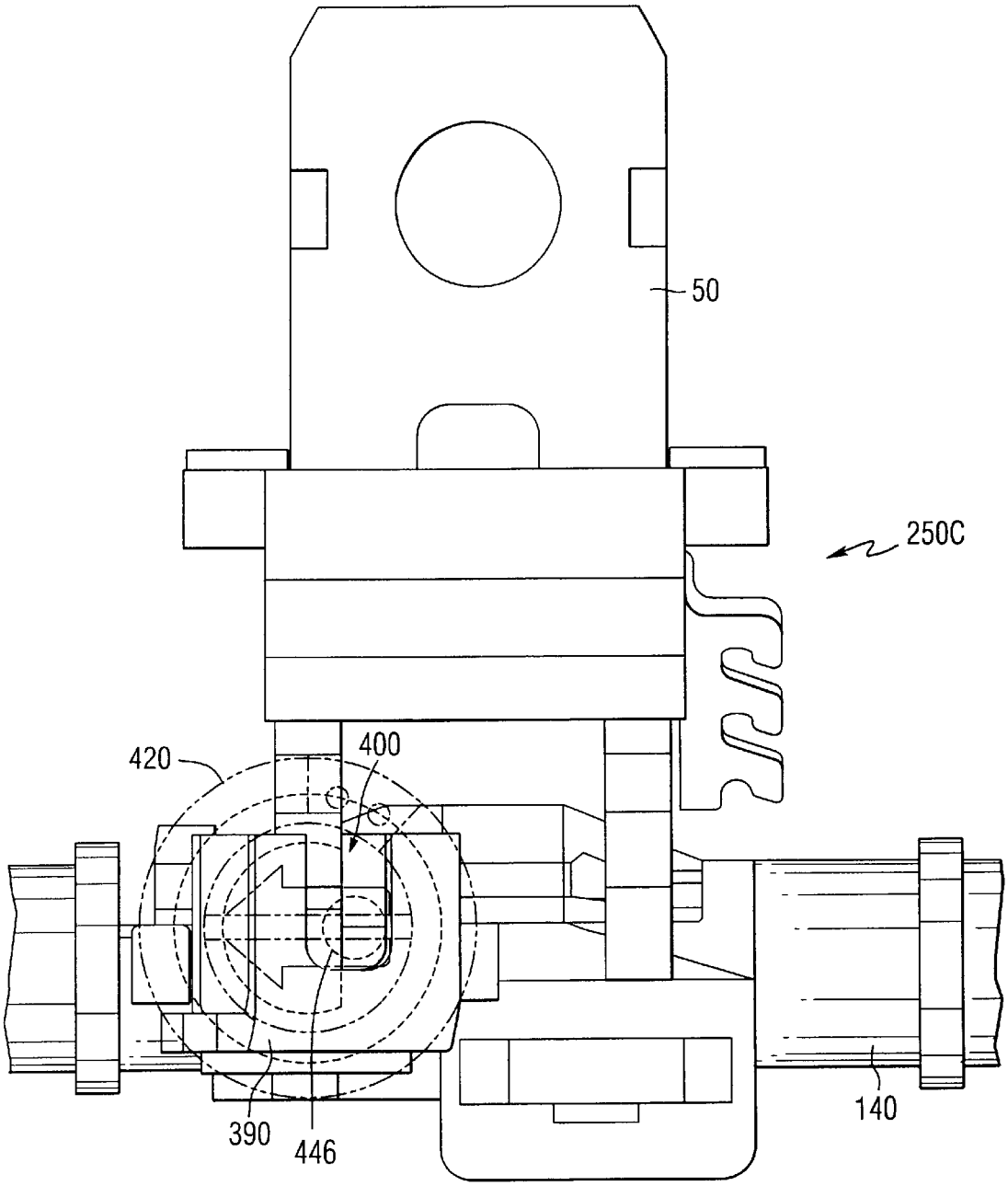

In particular, and referring now to FIGS. 18A, 18B, and 18C, protrusion 446 of connection member 440 is vertically positioned within recess 400 formed between prongs 396 and 398 of lever 390. As adjustment knob 420 is rotated by way of a tool such as a screwdriver inserted into slot 424, protrusion 446 of connection member 440, because of its off-center position, does not occupy the same position relative to the axis of rotation of knob 420. In particular, as adjustment knob 420 is rotated through its range of motion, the corresponding rotation of connection member 440 causes protrusion 446 to move along an arc-shaped path such as that depicted by the successive positions of protrusion 446 shown in FIGS. 18A, 18B, and 18C where adjustment knob 420 has been rotated clockwise through approximately 180 degrees representing its full range of motion. During such movement of protrusion 446, contact is made between protrusion 446 and either prong 396 or prong 398 (within recess 400) which moves the top of lever 390 which then causes lever 390 to rotate about its pivot axis. The range of rotation of lever 390 is best shown in FIGS. 17A and 17B (wherein adjustment knob 420 and connection member 440 are not shown for the sake of clarity). The position of lever 390 shown in FIG. 17A corresponds to the position of protrusion 446 shown in FIG. 18A, and the position of lever 390 shown in FIG. 17B corresponds to the position of protrusion 446 shown in FIG. 18C.

As lever 390 is caused to rotate due to the rotation of adjustment knob 420 in the manner described above, arm 402 at the bottom of lever 390 contacts head portion 356 of thermal trip slider 350 which causes thermal trip slider 350 to slide within recess 310 of trip bar 140, in the manner described above in connection with FIGS. 10A and 10B. It should be noted that the position of thermal trip slider 350 in FIG. 10B corresponds to its position shown in FIG. 17A. As thermal trip slider 350 slides as such, thermal trip members 142 of thermal trip slider 350 are moved in relation to stationary automatic trip assemblies 250A, 250B, 250C, and 250D. In particular, as shown in FIGS. 19A and 19B which depict an overhead view of a portion of trip mechanism 64, the sliding of thermal trip slider 350 adjusts the positioning of contact regions 364 of thermal trip members 142 (see FIG. 9) in relation to the positioning of front portions 264A of screws 264, where screws 264 have been screwed to a certain extent through bimetals 254 (only screws 264 and bimetals 254 of automatic trip assemblies 250C and 250D, and the portion of slider 350 corresponding thereto, are shown for the sake of clarity).

Figure 19A:
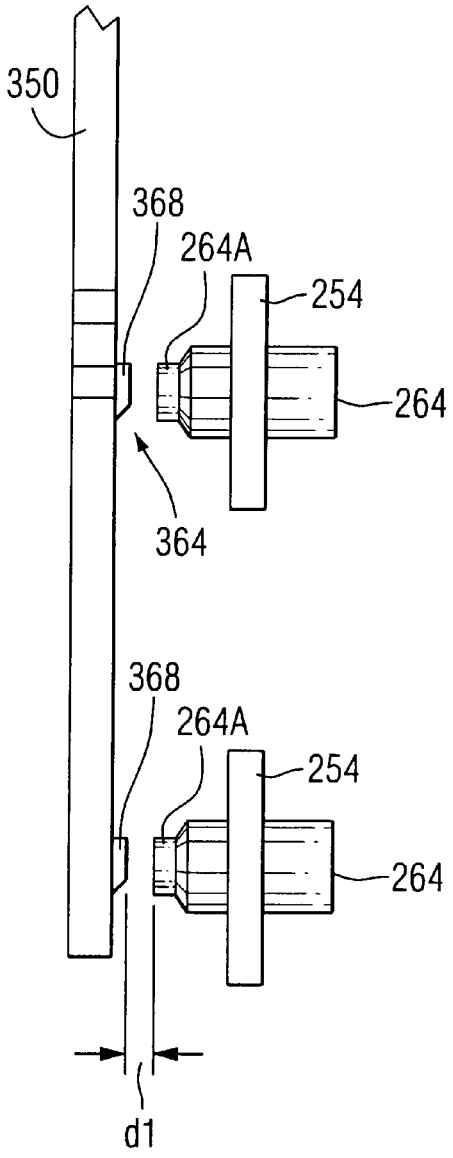
FIGS. 19A and 19B are overhead views of the relative positioning of the thermal trip slider shown in FIG. 9 with respect to screws attached to the bimetals of the automatic trip assemblies of the circuit interrupter of FIG. 1.
Figure 19B:
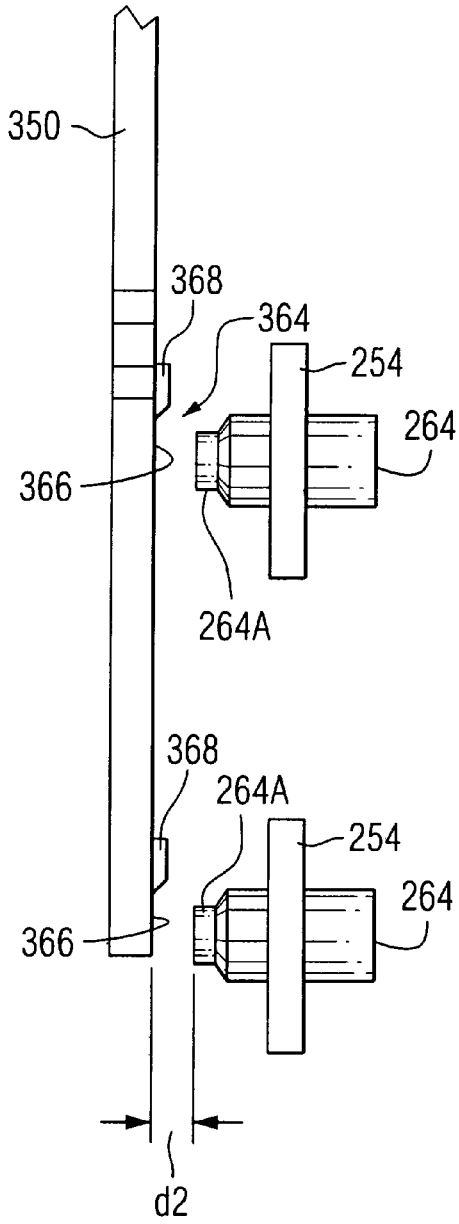

The position of contact regions 364 shown in FIG. 19A corresponds to the position of lever 390 and thermal trip slider 350 shown in FIG. 17A, and the position of contact regions 364 shown in FIG. 19B corresponds to the position of lever 390 and thermal trip slider 350 shown in FIG. 17B. In FIG. 19A, each of raised portions 368 of contact regions 364 is positioned to make contact with a corresponding screw 264 if the bimetal 254 (to which that screw 264 is attached) were to bend due to an overcurrent condition, with a distance d1 separating raised portions 368 from screws 264. In FIG. 19B, each of non-raised portions 366 of contact regions 364 is positioned to make contact with a corresponding screw 264 if the bimetal 254 (to which that screw 264 is attached) were to bend due to an overcurrent condition, with a distance d2 separating non-raised portions 366 from screws 264. Because distance d1 is less than distance d2, bimetals 254 need to deflect to a lesser extent when trip mechanism 64 is in the configuration shown in FIG. 19A than when trip mechanism 64 is in the configuration shown in FIG. 19B, in order for contact to be made with contact regions 364 whereby trip bar assembly 122 is rotated to thereby generate a thermal tripping operation.

Therefore, the predetermined threshold current level (overcurrent) capable of causing a thermal tripping operation is lower for the configuration of trip mechanism 64 shown in FIG. 19A than for the configuration shown in FIG. 19B.

To summarize, rotating externally-positioned adjustment knob 420 causes lever 390 to rotate which causes thermal trip slider 350 to slide which adjusts the positioning of contact regions 364 of thermal trip members 142 in relation to the positioning of screws 264 of automatic trip assemblies 250A, 250B, 250C, and 250D. In this manner, the thermal tripping operation of circuit breaker 10 can be adjusted. Because this adjustment is externally controlled, it advantageously does not require circuit breaker 10 to be opened. The adjustment also advantageously does not require the entire trip bar assembly 122 to slide within the housing of circuit breaker 10.

In the exemplary embodiment described above, two levels of externally controlled adjustment are provided for the thermal tripping operation. In other embodiments, one or more sets of additional raised portions (similar to the set of raised portions 368) may be added in step-wise fashion (each set raised to a differing extent) to contact regions 364 of thermal trip members 142, whereby movement of thermal trip slider 350 in the manner described above would be precisely controlled so that, at different angles of rotation of adjustment knob 420, a different set of raised portions (or the non-raised portions 366) would be aligned to make contact with screws 264. Each set of additional raised portions would thus add an additional level of externally controlled adjustment to the thermal tripping operation of circuit breaker 10.

Although the preferred embodiment of the present invention has been described with a certain degree of particularity, various changes to form and detail may be made without departing from the spirit and scope of the invention as hereinafter claimed.

We claim:

1. A circuit interrupter comprising:

a housing;

separable main contacts within said housing;

an operating mechanism within said housing and interconnected with said separable main contacts; and a trip mechanism within said housing and including a rotatable trip bar assembly that, when rotated, generates a tripping operation causing said operating mechanism to open said contacts, said trip bar assembly having a thermal trip member disposed for longitudinal movement in relation to said tip bar assembly, said trip mechanism further including a bimetal through which electrical current flows, said bimetal bending and contacting a contact area of said thermal trip member causing said trip bar assembly to rotate and generate said tripping operation upon a predetermined current threshold, said contact area having regions protruding to different extents towards said bimetal, wherein when said thermal member is longitudinally moved in relation to said trip bar assembly, a different one of said regions of said contact area of said thermal trip member is positioned to be contacted by said bimetal whereby said predetermined current threshold is changed.

2. The circuit interrupter as defined in claim 1 wherein said trip bar assembly includes a thermal trip slider to which said thermal trip member is attached, said thermal trip slider disposed for longitudinal movement within said trip bar assembly.

3. The circuit interrupter as defined in claim 2 wherein said trip bar assembly includes a recess in which said thermal trip slider longitudinally moves, said trip bar assembly further including a bottom with an opening formed therein into which said thermal trip slider is inserted for positioning within said recess.

4. The circuit interrupter as defined in claim 2 where said trip bar assembly includes a plurality of said thermal trip members each of which is attached to said thermal trip slider.

5. The circuit interrupter as defined in claim 2 wherein said trip mechanism further includes a lever rotatable about an axis and having a first end positioned for contacting said thermal trip slider, said trip mechanism further including an adjustment actuator accessible from a point external of said housing and positioned for contacting a second end of said lever, wherein actuation of said adjustment actuator causes said lever to rotate about said axis and to contact said thermal trip slider thereby moving said thermal trip slider longitudinally within said trip bar assembly.

6. The circuit interrupter as defined in claim 5 wherein said thermal trip slider includes a head portion which said first end of said lever contacts.

7. The circuit interrupter as defined in claim 5 wherein said adjustment actuator includes an adjustment knob interconnected with a connection member, said adjustment knob accessible from said point external of said housing, said connection member located within said housing and positioned for contacting said second end of said lever.

8. The circuit interrupter as defined in claim 7 wherein said adjustment knob and said connection member rotate along a second axis of rotation when said adjustment actuator is actuated, said adjustment knob including a protrusion extending parallel with but off of said second axis and positioned for contacting said second end of said lever.

9. The circuit interrupter as defined in claim 8 wherein said second end of said lever includes a recess in which said protrusion is positioned.

10. The circuit interrupter as defined in claim 1 wherein said bimetal includes a screw extending therethrough that contacts said contact area of said thermal trip member when said bimetal bends upon said predetermined current threshold.

11. A circuit interrupter comprising:

a housing;

separable main contacts within said housing;

an operating mechanism within said housing and interconnected with said separable main contacts; and a trip mechanism within said housing and including a trip bar assembly rotatable about an axis and that, when rotated, generates a tripping operation causing said operating mechanism to open said contacts, said trip bar assembly having a trip member translatable along said axis, said trip mechanism further including a tripping actuator movable along a predetermined path of travel as a function of electrical current, said tripping actuator contacting a contact area of said trip member at a predetermined location along said predetermined path of travel of said tripping actuator and causing said trip bar assembly to rotate and generate said tripping operation upon a predetermined current threshold, wherein when said trip member is translated along said axis, said contact area is contacted by said tripping actuator at a different location along said predetermined path of travel of said tripping actuator whereby said predetermined current threshold is changed.

12. The circuit interrupter as defined in claim 11 wherein said trip bar assembly includes a trip slider to which said trip member is attached, said trip slider disposed for longitudinal movement within said trip bar assembly.

13. The circuit interrupter as defined in claim 12 wherein said trip bar assembly includes a recess in which said trip slider longitudinally moves, said trip bar assembly further including a bottom with an opening formed therein into which said trip slider is inserted for positioning within said recess.

14. The circuit interrupter as defined in claim 12 where said trip bar assembly includes a plurality of said trip members each of which is attached to said trip slider.

15. The circuit interrupter as defined in claim 12 wherein said trip mechanism further includes a lever rotatable about a second axis and having a first end positioned for contacting said trip slider, said trip mechanism further including an adjustment actuator accessible from a point external of said housing and positioned for contacting a second end of said lever, wherein actuation of said adjustment actuator causes said lever to rotate about said second axis and to contact said trip slider thereby moving said trip slider longitudinally within said trip bar assembly.

16. The circuit interrupter as defined in claim 15 wherein said trip slider includes a head portion which said first end of said lever contacts.

17. The circuit interrupter as defined in claim 15 wherein said adjustment actuator includes an adjustment knob interconnected with a connection member, said adjustment knob accessible from said point external of said housing, said connection member located within housing and positioned for contacting said second end of said lever.

18. The circuit interrupter as defined claim 17 wherein said adjustment knob and said connection member rotate along a third axis of rotation when said adjustment actuator is actuated, said adjustment knob including a protrusion extending parallel with but off of said third axis and positioned for contacting said second end of said lever.

19. The circuit interrupter as defined in claim 18 wherein said second end of rotrusion is positioned.

20. The circuit interrupter as defined in claim 11 wherein said tripping actuator is a bimental, said bimetal including a screw extending therethrough that contacts said contact area of said trip member when said bimetal bends upon said predetermined current threshold.

* * * * *